United States Patent [19]

Izume

[11] Patent Number: 4,500,082

[45] Date of Patent: Feb. 19, 1985

[54] ROTARY BUSINESS FORM PRINTING PRESS

[75] Inventor: Masayuki Izume, Kyoto, Japan

[73] Assignee: Taiyo Ltd., Osaka, Japan

[21] Appl. No.: 556,921

[22] Filed: Nov. 30, 1983

[51] Int. Cl.[3] ..... B41F 13/56

[52] U.S. Cl. ..... 270/20.1; 101/248; 101/348

[58] Field of Search ..... 270/20.1, 1.1, 39, 4, 270/8; 101/248, 24, 348, 349

[56] References Cited

U.S. PATENT DOCUMENTS

| | | | |
|---|---|---|---|
| 1,878,904 | 9/1932 | Smith | 270/20.1 |
| 3,572,681 | 3/1971 | Nystrand | 270/39 |
| 4,177,730 | 12/1979 | Schriber et al. | 101/248 |
| 4,222,325 | 9/1980 | Edwards | 101/248 X |
| 4,254,947 | 3/1981 | Trogan | 270/39 |

FOREIGN PATENT DOCUMENTS

| | | | |
|---|---|---|---|
| 2614665 | 10/1976 | Fed. Rep. of Germany | 270/4 |

*Primary Examiner*—E. H. Eickholt
*Attorney, Agent, or Firm*—Gabriel P. Katona

[57] ABSTRACT

A rotary business form printing press wherein a differential gear for controlling the velocity of the roller is provided between a feed roller in a sheet feed mechanism and the drive mechanism, an adjustment device for the impression cylinder for adjusting the wheel base between an impression cylinder and a blanket cylinder is provided in the impression cylinder, motors for adjusting the positions are provided on wheels in a punching unit and in processing heads in a slitter and a vertical perforation unit, rotational angle detecting devices are provided on respective revolving shafts of a plate cylinder, wheels in the punching unit, a perforation cylinder and crank discs in a zig-zag folding unit, and differential gears for adjusting the vertical register are provided between these revolving shafts and the drive mechanism. In this rotary business form printing press the rotating speed of the feed roller according to the previously-set paper thickness, the wheel base between the impression cylinder and the blanket cylinder, the positions of wheels and processing heads according to the previously-set contents and the vertical registers in the plate cylinder, the punching unit, the perforation cylinder and the zig-zag folding unit are automatically adjusted by the control unit.

15 Claims, 19 Drawing Figures

1
2
3
4
5
6
7
8
9
10
11
12
13
14
158
159
160
161
162
206
211
212

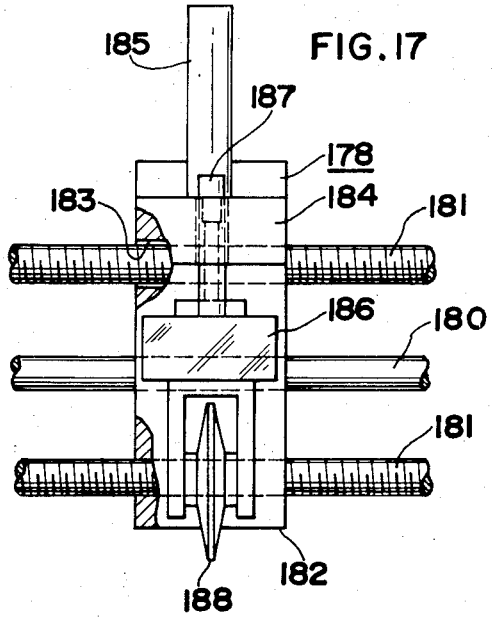
FIG. 17
FIG. 18
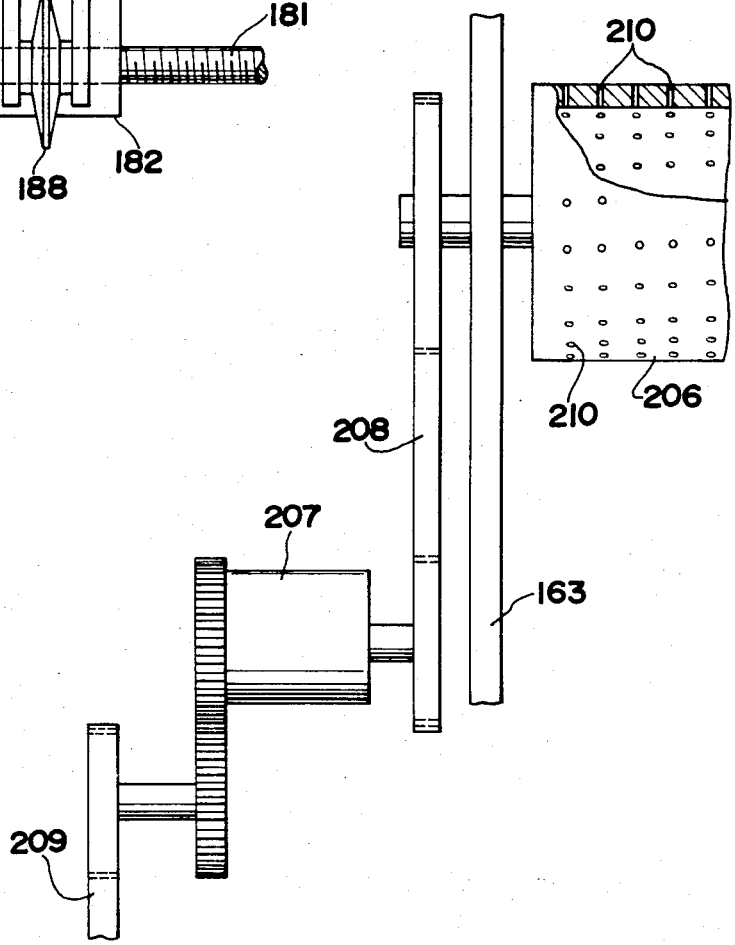

ROTARY BUSINESS FORM PRINTING PRESS

BRIEF SUMMARY OF THE INVENTION

The present invention relates to a rotary form printing press (rotary business form printing press), more in detail, to a rotary form printing press which performs printing and processing of business forms on webs.

A conventionally-known rotary form printing press of this kind is of a type comprising a sheet feed mechanism having a roller for feeding webs, a printing mechanism having a plate cylinder and an impression cylinder which contacts thereto directly or through a blanket cylinder, a punching unit having pin wheels and die wheels which form counterparts thereto, a slitter having processing heads provided with cutters, a vertical perforation unit having processing heads provided with vertical perforating cutters, a cross perforation unit having a perforation cylinder, a zig-zag folding unit and their drive mechanism. In such a type of rotary form printing press, it is necessary to adjust the vertical register of the positions to be printed and processed on the paper, the positions of the wheels in the punching unit and of the processing heads in the slitter and the vertical perforation unit as well as the wheel base between the impression cylinder and the plate cylinder or the blanket cylinder contacting thereto according to the paper thickness and the rotating speed of the feed roller, before starting the operation. In the conventional rotary form printing press, however, trial printings and adjustments should be carried out several times before starting the operation, since the adjustments as mentioned above are manually carried out. As a result, it takes much time before it is ready to start the operation.

The spread of computers among every industry in recent years has diversified the needs to business forms as output forms for computers and obliges the suppliers of business forms to supply multiple kinds of forms on a small-scale production. Therefore, what is desired to a rotary form printing press is an increase in the operating ratio by reducing the time required for the preparation for the printing as well as a reduction of the time for the printing by performing high-speed printing. In a conventional rotary form printing press, however, a long preparatory time is required as mentioned above, and consequently, the substantial operating ratio is very low.

The object of the present invention is to provide a rotary business form printing press wherein the adjustments which should be carried out before starting the operation can be performed automatically and the preparatory time for the operation can remarkably be shortened.

Another object of the present invention is to perform the adjustments automatically even when the web is changed. This type of rotary form printing press is generally designed in such a manner that the rotation of a single driving shaft is transmitted to each part, and since in the conventional driving devices the rotation of the driving shaft is transmitted to each part at equal velocity or slightly increasing velocity through a bevel gear, the driving shaft rotates at high torque and low velocity. Therefore, the torsion of the driving shaft increases, and since this torsion is transmitted to each part at equal velocity or slightly increasing velocity, there is a danger of the position to be printed or to be processed being out of vertical register.

Therefore, other object of the present invention is to reduce considerably the degree of the errors in the register of the position to be printed or to be processed in the longitudinal direction.

A printing mechanism of a rotary form printing preaa of this kind is provided with an inking arrangement having an ink ductor between an ink fountain roller and an ink distributing roller. It is constructed that the ink ductor is provided at an oscillating end portion of a lever for the ink ductor which is provided capably of oscillating to a frame, when the lever has been made to oscillate, and the ink ductor con tacts alternately to the ink fountain roller and the ink distributing roller to transfer the ink from the ink fountain roller to the ink distributing roller by a fixed amount at a time. In a conventional inking arrangement, however, the ink ductor contacts merely alternately to the ink fountain roller and the ink distributing roller and the ink ductor cannot contact to both rollers simultaneously. Therefore, in cleaning the inking arrangement, the cleaning liquid applied on the ink distributing roller and the like cannot be transferred to the ink fountain roller. Consequently, the ink fountain roller cannot be cleaned merely by applying the cleaning liquid on the ink distributing roller and the like. So it is necessary to clean the ink fountain roller separately.

Therefore, other object of the present invention is to make it possible to clean the ink fountain roller simultaneously with other rollers such as the ink distributing roller.

A rotary form printing press of this kind is provided with a plural number of cylinders-for-printing replacement units which are attachable to the frame of the printing mechanism capably of detaching, and each unit is replaceable one another for use according to the necessity. Each replacement unit has at least a plate cylinder and a blanket cylinder or an impression cylinder which contact thereto. In a conventional rotary form printing press, the replacement units are attached and detached in the following manner. When a replacement unit is attached, a replacement unit is moved on a truck having casters to a side of the bed of the printing mechanism, then the unit is pushingly transferred from the truck on to the bed to fix it to the frame. When a replacement unit is detached, the unit is transferred from on the bed to the truck put on a side of the bed, then the unit is moved on the truck. On such an occasion, in a conventional rotary form printing press, the replacing work is difficult one, and in addition, it takes much time to perform this work because it requires moving relatively heavy replacement units between the truck and bed.

Each replacement unit is provided with a plate cylinder of a different diameter, and two form rollers which contact to this plate cylinder and the positions are adjustable are provided to the frame. In a conventional rotary form printing press, however, when a plate cylinder of a different diameter is used, the positions of the two form rollers contacting to this plate cylinder change. Therefore, it is necessary to adjust the positions of the form rollers each time the units are replaced, which results in a long preparatory time for the operation.

Therefore, other object of the present invention is to shorten the time required for the work for replacing the cylinders-for-printing replacement units in addition to making it easier and making it unnecessary to adjust the positions of form rollers even when the replacement units are replaced.

In a rotary form printing press of this kind, it is necessary to adjust the above-mentioned wheel base between the impression cylinder and the plate cylinder or the blanket cylinder contacting thereto according to the paper thickness of the web to be used, and such an adjustment is a work not only troublesome but also requiring much time.

Therefore, other object of the present invention is to make it possible to adjust very easily the wheel base between the impression cylinder and the plate cylinder or the blanket cylinder contacting thereto.

In a rotary form printing press of this kind, a tension control device provided with a dancer roller held rotatably between the oscillating end portions of a pair of oscillating arms is provided to keep the tension of the web fed from the sheet feed mechanism constant. And in a conventional rotary form printing press, springs are provided between the oscillating arms and the frame of the sheet feed mechanism, otherwise, dead weights are attached to the oscillating arms, in order to give a constant tension to the web wound on the dancer roller. But in the case where springs are used, if the position of the dancer roller varies, the spring tension also varies, so the tension of the web varies. In the case where weights are used, impact loads are sometimes generated on the web due to their inertia force. In this way, in the case of a conventional tension control device wherein springs or dead weights are used, it is difficult to keep the tension of the web fed from the sheet feed mechanism constant.

Therefore, other object of the present invention is to make it possible to keep the tension of the web fed from the sheet feed mechanism constant.

In a conventional rotary form printing press, a pressing roller is provided in order to prevent the paper from slipping on the surface of a receiving roller, and thereby the paper is pushed against the surface of the receiving roller. As a result, there is a danger of the printing surface of the paper being stained by the pressing roller. The receiving roller is directly connected to the drive shaft by gears or the like and rotates always at constant speed. When a difference arises between the speed of the paper and the surface speed of the receiving roller as a result of a change of the paper thickness, the slipping is generated between the paper and the receiving roller, thereby there is a danger of the static electricity being generated. Moreover, the frictional force due to this slipping upon starting the receiving roller differs from that during the rotation of the receiving roller, and varies according to a change in the speed. As a result, the tension of the paper varies. Consequently, the paper expands and contracts, which results in a danger of generating the errors in the register of the positions to be printed or to be processed in the vertical direction of the paper.

Therefore, other object of the present invention is to make it unnecessary to provide a pressing roller, to remove the dangers of staining the printing surface of the paper and of any slipping being generated between the web and the receiving roller.

Other objects of the present invention will become more apparent from the descriptions given hereinafter and the appended drawings.

BRIEF DESCRIPTION OF THE DRAWINGS

FIG. 17 is a front view of a processing head in the slitter;

FIG. 18 is an enlarged cross-sectional view taken on line XVIII—XVIII of FIG. 14.

DETAILED DESCRIPTION OF THE INVENTION

Figures 1, 2:
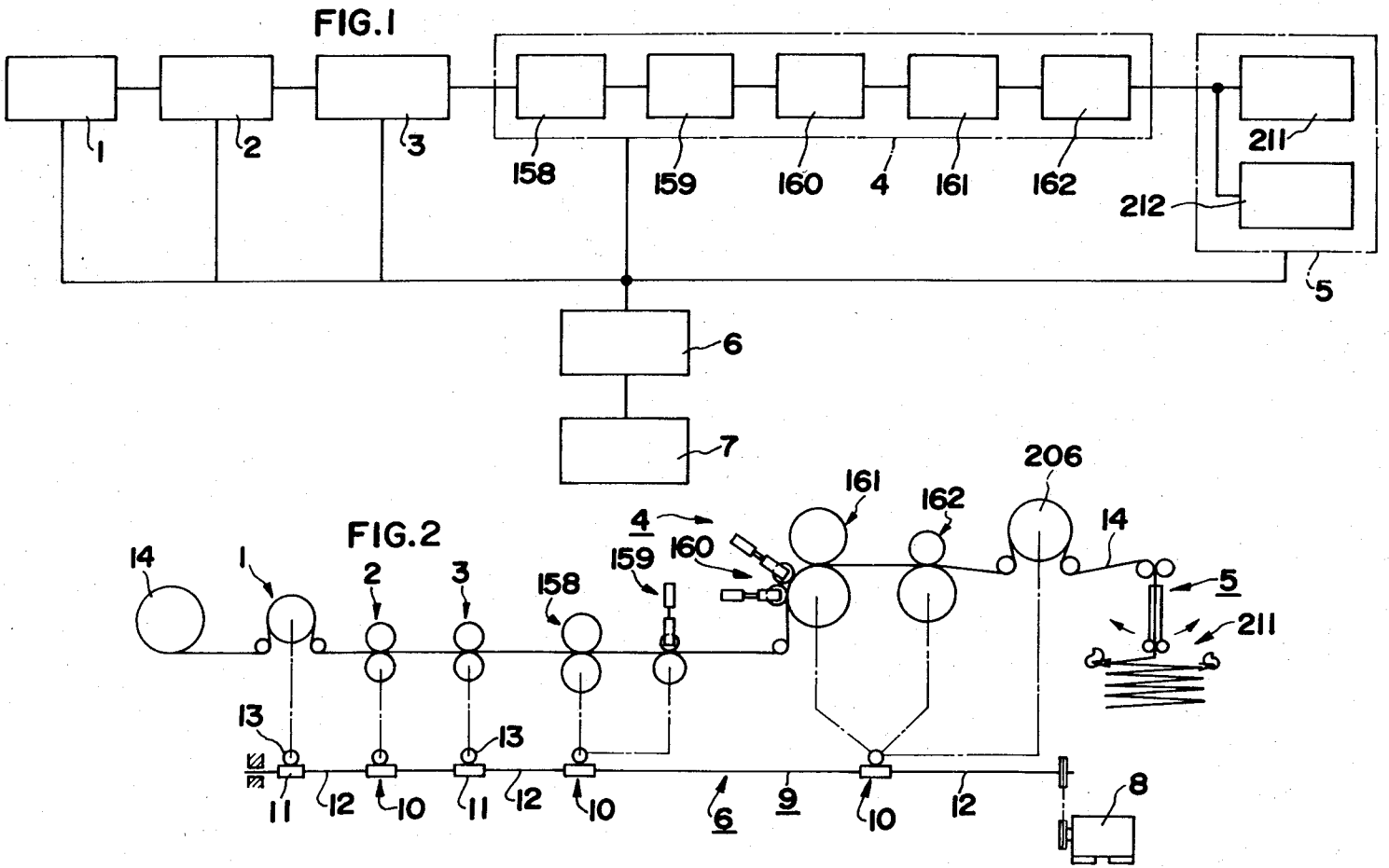
FIG. 1 is a construction view of the rotary offset business form printing press according to the present invention.
FIG. 2 is an explanatory view showing the drive mechanism and the flow of the printing paper.

Referring to the drawings, there will be given explanations of the embodiments of the present invention. In this specification, "forward", "backward", "right" or "left" is used with respect to the advancing direction of the web.

The drawings show a rotary offset form printing press. As shown in FIGS. 1 and 2, this rotary printing press comprises a sheet feed mechanism 1, an offset printing mechanism 2, a back-carbonizing mechanism 3, a processing machine 4, a delivery machine 5, and their drive mechanism 6 and control unit 7.

The drive mechanism 6 is provided with a drive motor 8, a drive shaft 9 which rotates at constant speed driven by the motor and worm reduction gears 10 provided at several places on the drive shaft 9. The drive shaft 9 is constructed in such a manner that the worms 11 of these reduction gears 10 are alternately connected to a plural number of hollow shafts 12 to form a straight line and extends horizontally in the longitudinal direction. And, as will be mentioned later, the rotation of the worm gear 13 of each reduction gear 10 is transmitted to each part of the rotary form printing press. In a conventional rotary form printing press, the drive shaft rotates at high torque and low speed, because the rotation of the drive shaft is transmitted to each part at equal velocity or slightly increasing velocity. In the rotary form printing press, however, the rotation of the drive shaft 9 is reducibly transmitted to each part so that the drive shaft 9 rotates at lower torque and higher velocity in comparison to a conventional one.

The control unit 7 controls the whole of the rotary form printing press and comprises a central control panel and a plural number of local control panels (both are not shown in the drawings), the latter being provided properly at each part of the rotary form printing press. The central control panel is provided with a microcomputer, various operational switches, indicators and the like, while the local control panels are provided with various operational switches, indicators and the like.

The sheet feed mechanism 1 is used to feed a web 14 continually to the offset printing mechanism 2 with a constant tension at a constant speed and constructed as follows. (See FIGS. 3–5).

Figure 3:
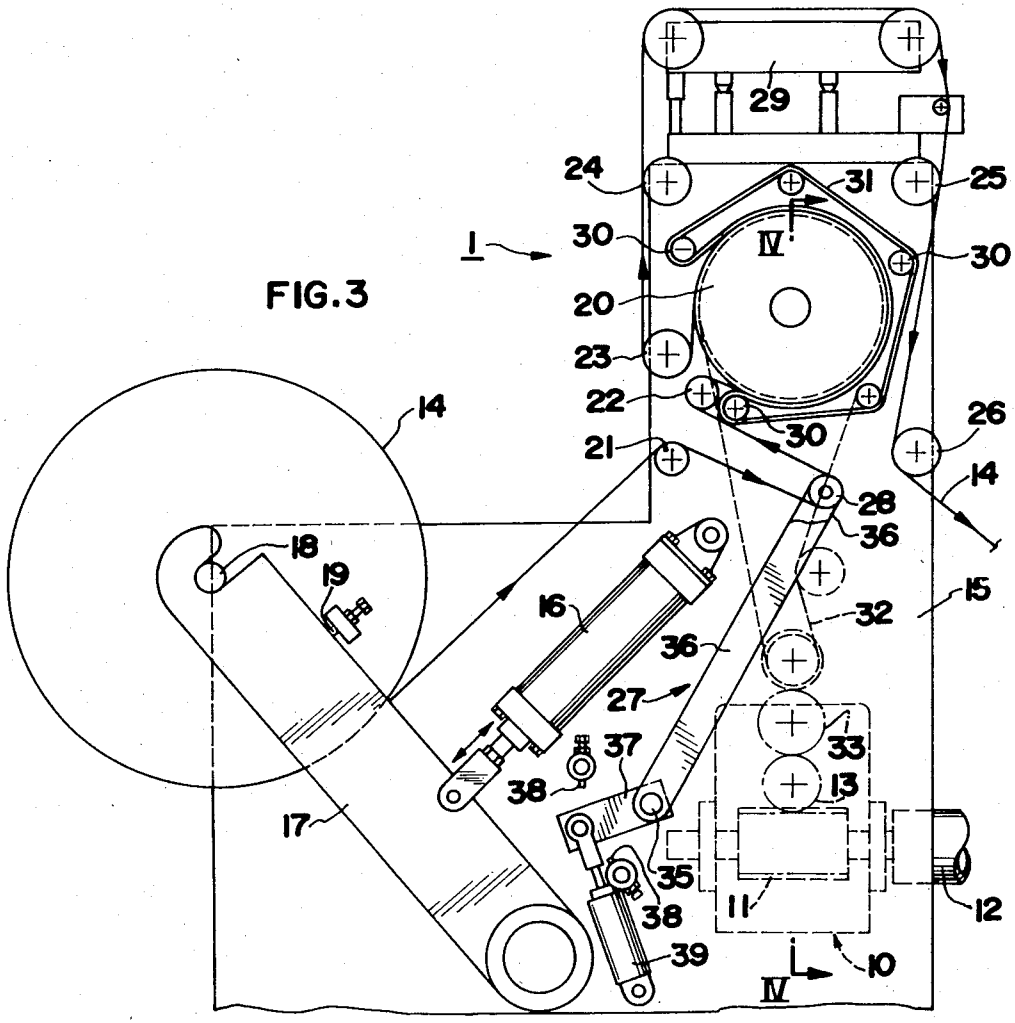
FIG. 3 is a vertical section of the sheet feed mechanism.

At the bottom of the rearward of a frame 15 of the sheet feed mechanism 1, arms 17 forming a pair on both the right and left sides which are capable of rotating longitudinally by air cylinders 16 also forming a pair on both the right and left sides are provided. A sheet-feeding shaft 18 on which the web 14 is fixed is held between the rotatable end portions of the arms 17 capably of rotating. At an end of the sheet-feeding shaft 18, a powder brake (not shown in the drawings) is provided. As shown in FIG. 3, the arms 17 forming a pair on both right and left sides rotate downward in the mounting operation of the web 14 and rotate upward and contact to a stopper 19 which is mounted on the frame 15 and which position is adjustable to stop its motion.

At the front part of the frame 15, a feed roller 20 and a plural number of rollers 21, 22, 23, 24, 25 and 26 are held capably of rotating. The web 14 passes through the roller 21, a dancer roller 28 of the tension control device 27, the roller 22, the feed roller 20, rollers 23, 24, edge guiders 29 which prevent the paper 14 from meandering and rollers 25, 26 in these orders. A plural number of small rollers 30 held by the frame 15 are wound by a plurality of endless rubber belts 31, and these belts 31 press the web 14 to the feed roller 20.

Figure 4:
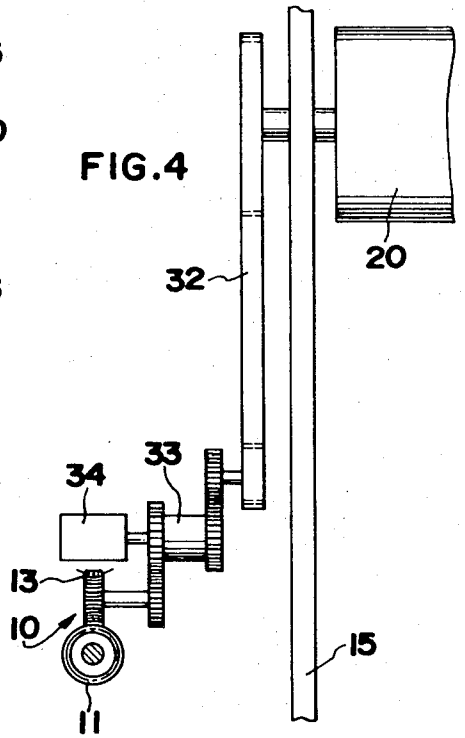
FIG. 4 is a cross-sectional view taken on line IV—IV of FIG. 3.

As shown in detail in FIG. 4, the feed roller 20 is connected to the worm gear 13 of one of the reduction gears 10 of the drive mechanism through a timing belt 32 and a differential gear 33 for controlling the velocity of the feed roller 20. The differential gear 33 is provided with a servomotor 34 which velocity is controlled by the control unit 7 and makes the feed roller 20 to rotate at a rotational speed corresponding to that of the motor 34 and that of the worm gear 13. The rotational speed of the motor 34 can be changed into a desired positive value or negative one with the rotational frequency zero being the basis. As mentioned above, the drive shaft 9, namely worm gears 13 rotate at constant speed. By changing the rotational speed of the motor 34, that of the feed roller 20 changes. While the motor 34 keeps stopping or it is rotating at constant speed, the feed roller 20 also rotates at constant speed correspondingly thereto. The differential gear 33 is used to feed the web 14 at constant speed even when the paper thickness of the web 14 has changed. If the feed roller 20 is constructed so as to rotate at constant speed usually, then the speed of the web which is wound around the feed roller 20 and passes this portion, namely the feed speed of the web changes when the paper thickness of the web has changed. Therefore, in order to feed the web 14 usually at constant speed, it is necessary to change the rotational speed of the feed roller 20, namely that of the motor 34 according to the paper thickness. The rotational speed of the motor 34 can be set directly by the numerical control from the control unit 7 by the operator (hereinafter called merely the "numerical control"). As will be explained hereinafter, it can also be set automatically by the control unit 7 by pushing the automatic adjusting button of the control unit 7 before starting the operation. That is, since the control unit 7 memorizes the relations between the paper thickness of the web and the rotational speed of the feed roller 20, namely that of the motor 34 in order to make the feed speed of the web 14 constant, it sets the rotational speed of the motor 34 according to the paper thickness set in the control unit 7 when the automatic adjusting button is pushed on and makes it rotate at this speed during operation. In this way the rotational speed of the motor 34, namely that of the feed roller 20 can change according to the paper thickness of the web 14, whereby the web 14 is fed to the offset printing mechanism 2 usually at constant speed. The paper thickness is set in the control unit 7 every time the paper thickness of the web changes. Once a form to be printed is decided, then the paper thickness is correspondingly decide. Therefore, it is also possible to construct that the paper thickness is set automatically by making the control unit 7 memorize the paper thickness corresponding to each kind of business form beforehand and thereafter merely selecting the kind of business forms. It is also possible to change the rotational speed of the motor 34 which has already been set automatically by a numerical control before starting the operation or during the operation.

Figure 5:
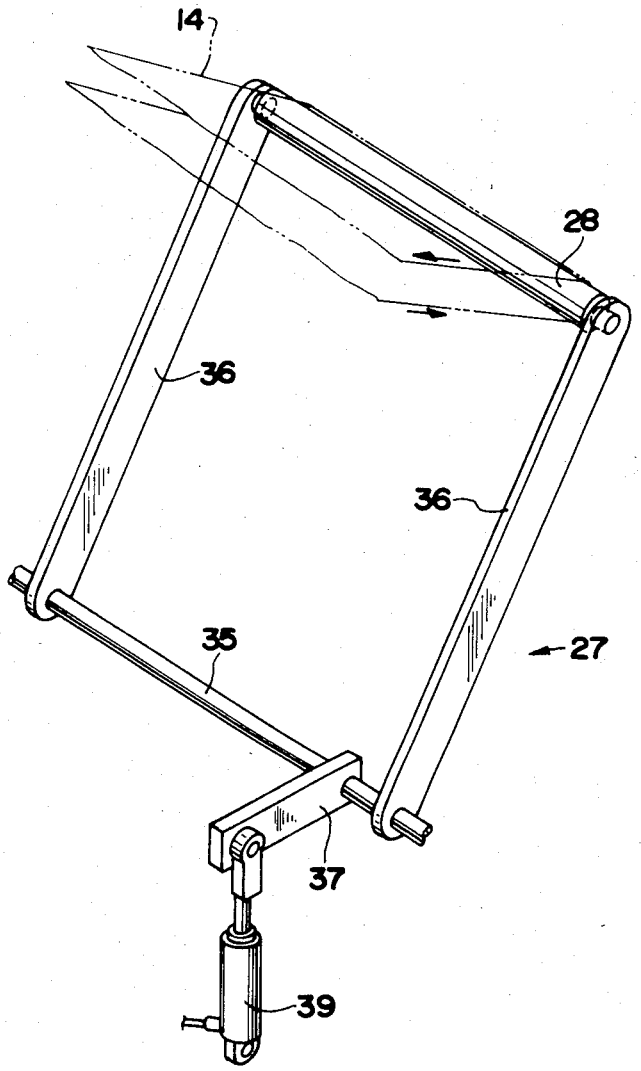
FIG. 5 is a perspective view of the tension control device in the sheet feed mechanism.

As shown in detail in FIG. 5, the tension control device 27 is provided with a shaft 35 held rotatably by the frame 15, relatively long oscillating arms 36 forming a pair on both right and left sides, one end of each thereof being fixed at both ends of the shaft 35, a dancer roller 28 held rotatably between the rotatable end portions of both arms 36, on which the web 14 is put, a relatively short lever 37, one end thereof being fixed at one end of the shaft 35, two stoppers 38 mounted to the frame 15 in order to regulate the oscillation width of the lever 37, which positions being adjustable, and an air cylinder 39 provided between the oscillating end portion of the lever 37 and the frame 15. Moreover, the chamber of the air cylinder 39 on the side where the pressure due to the tension of the web 14 exerts is connected to the air source through a pressure regulating valve, which illustration being omitted. Therefore, the air pressure in this chamber is kept constant and, as the air has no inertia force, the tension of the web 14 is kept constant even if the dancer roller 28 varies its position. So there is no danger of the tension of the web 14 varying or of the impact load generating as used to be in a conventional tension control device. Furthermore, since one end of the air cylinder 39 is attached to the oscillating end portion of the relatively short lever 37, the amount of travel of the rod of the air cylinder 39 is very small even if the dancer roller 28 changes its position. Also it is possible to change the tension of the web 14 desirably and easily by changing the air pressure in the air cylinder 39 through a change of the contents set in the pressure adjusting valve.

Figure 6:
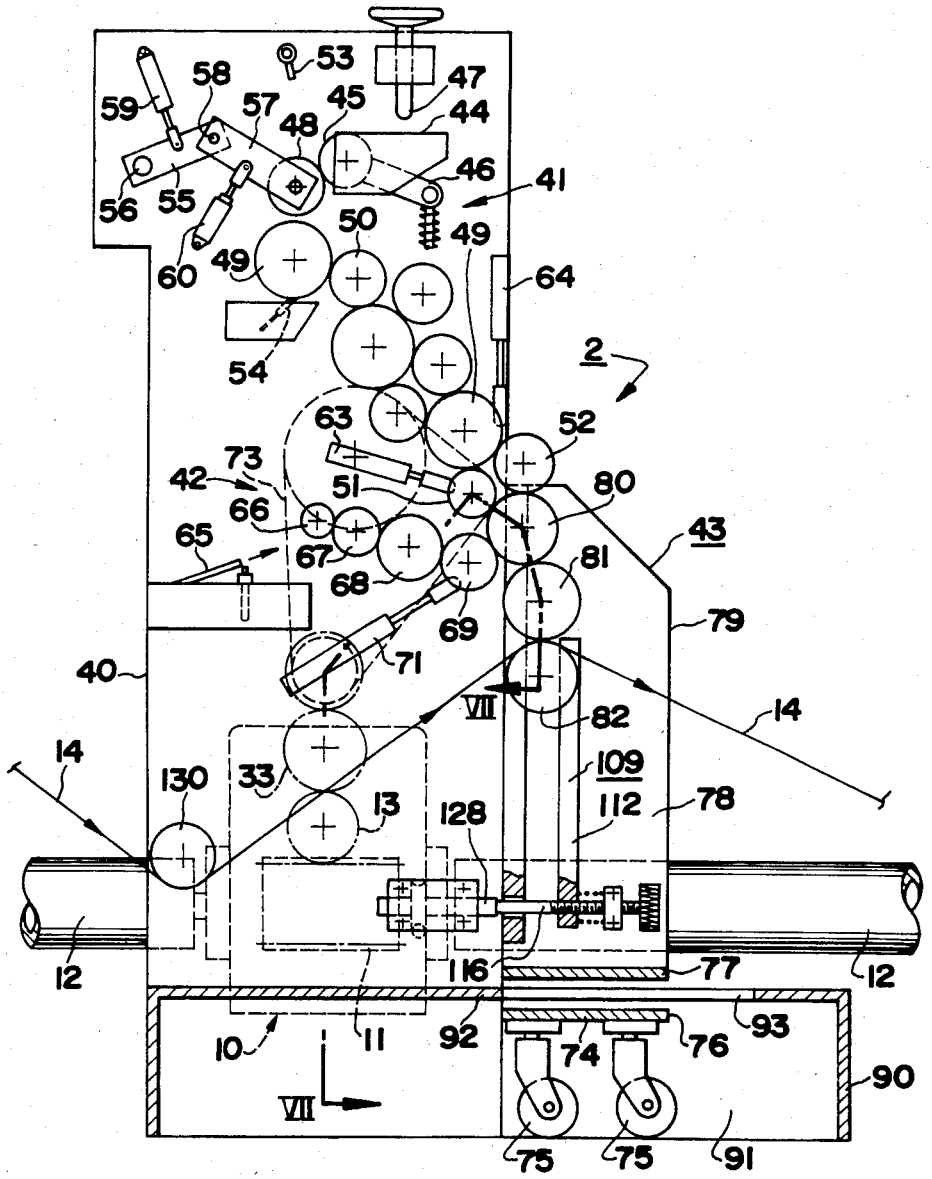
FIG. 6 is a vertical section of the offset printing mechanism.
Figure 7:
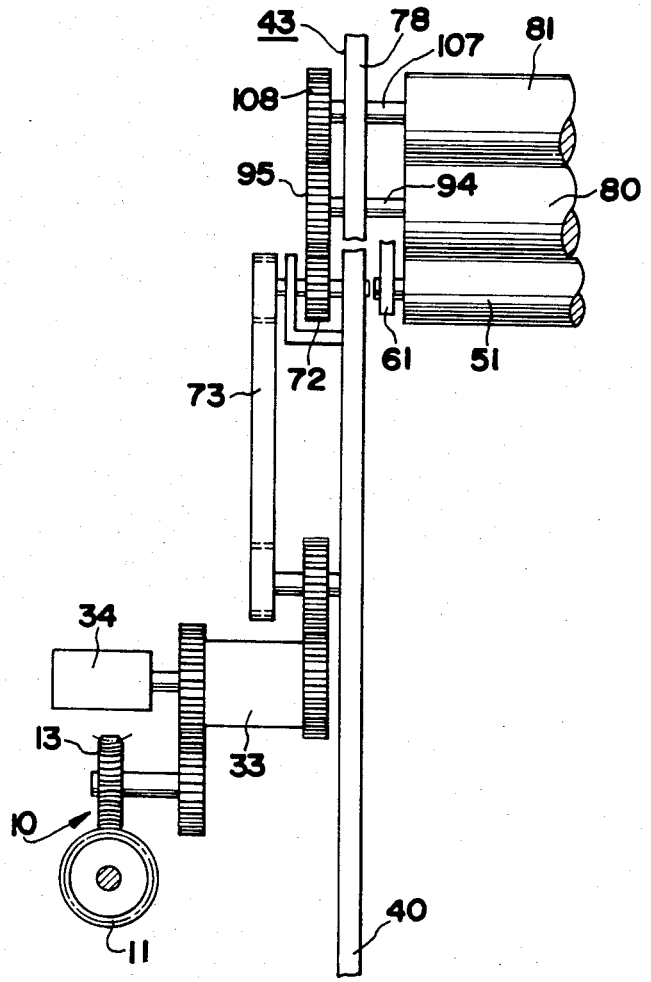
FIG. 7 is a cross-sectional view taken on line VII—VII of FIG. 6.

The details of the offset printing mechanism 2 are shown in FIGS. 6–12. As shown in FIG. 6, this printing mechanism 2 comprises an inking arrangement 41 and a dampening arrangement 42 which are mounted to a frame 40, and a cylinders-for-printing replacement unit 43 which is detachably mounted to the frame 40.

Figure 11:
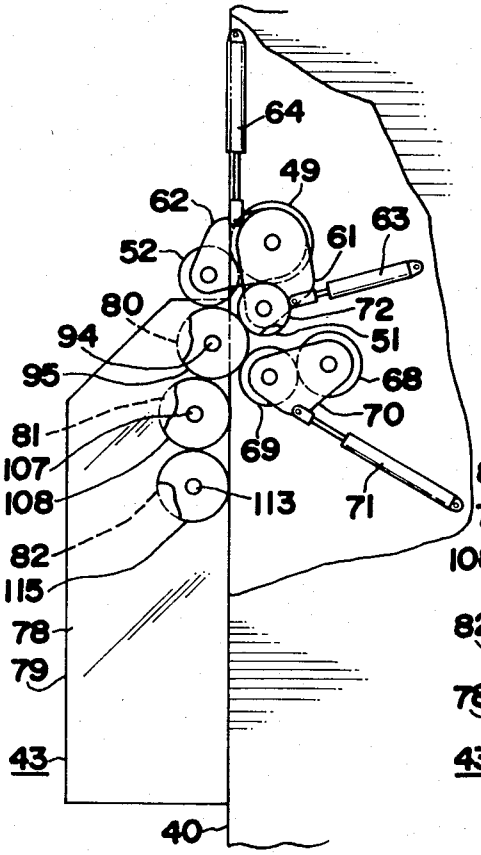
FIG. 11 is a side view taken on line XI—XI of FIG. 9.

An inking arrangement is provided with an ink fountain 44, an ink fountain roller 45, an arm 46 for driving the rotation of the ink fountain roller, a stopper 47 for adjusting the amount of rotation of the ink fountain roller, an ink ductor 48, a plural number of ink distributing rollers 49, 50, two form rollers 51, 52, a cleaning nozzle 53 and a doctor. (See FIG. 6.) The ink fountain roller 45 is attached to one end of the arm 46 through a one-way clutch (not shown in the drawings). The arm 46 moves upward and downward with the axis of the ink fountain roller 45 centered, and the ink fountain roller 45 rotates little by little when the arm 46 moves downward. The ink ductor 48 is provided between the ink fountain roller 45 and the ink distributing roller 49 in the following manner. That is, one end portion of a change-over lever 55 is attached to the frame 40 so that the change-over lever may move with a shaft 56 centered, and at the same time one end portion of a lever for the ink ductor 57 is attached to the movable end portion of the change-over lever 55 so that the lever for the ink ductor may move with a shaft 58 centered, and the ink ductor 48 is attached to the oscillating end portion of the lever for the ink ductor 57. An air cylinder 59 for driving the change-over lever is provided between the intermediate part of the change-over lever 55 and the frame 40, and an air cylinder 60 for driving the lever for the ink ductor between the intermediate part of the lever for the ink ductor 57 and the frame 40. The air cylinder 59 for driving the change-over lever is used to change over the position of the change-over lever 55, namely the position of the central axis for the rotation 58 of the lever for the ink ductor 57 according to whether the press is in operation or the inking arrangement is being cleaned. In operation, the change-over lever 55 stops at the position shown in FIG. 6. By expanding and contracting the air cylinder 60 for driving the lever for the ink ductor at this state to make the lver for the ink ductor 57 oscillate, the ink ductor 48 contacts to the ink fountain roller 45 and the ink distributing roller 49 alternately to transfer the ink from the ink fountain roller 45 to the ink distributing roller 49 in a fixed amounts. During the cleaning operation of the inking arrangement 41, the change-over lever 55 stops at a position travelled a little clockwise in FIG. 6 from the position mentioned above, thereby the ink ductor 48 contacts to both the ink fountain roller 45 and the ink distributing roller 49 simultaneously. Both end portions of each of two form rollers 51, 52 are respectively attached to the rotating end portions of two levers 61, 62 which are rotatable separately with the central axis of rotation of the ink distributing roller 49 to which said form rollers contact centered, and air cylinders 63, 64 are provided between these levers 61, 62 and the frame 40 respectively. (See FIG. 11.) In operation, these form rollers 51, 52 are located at certain operational positions as shown in FIGS. 6 and 11.

The dampening arrangement 42 is provided with a spraying water feeder 65 and rollers 66, 67, 68 and 69. (See FIG. 6.) Both end portions of the water distributing roller 69 are attached to the rotating end portions of a lever 70 which is rotatable with the axis of rotation of the roller 64 to which said roller contacts centered, and an air cylinder 71 is provided between the lever 70 and the frame 40. (See FIG. 11.)

To the frame 40 of the offset printing mechanism 2 attached a gear for driving the cylinders-for-printing 72 which is substantially coaxial with the form roller 51 positioned at the operational position. (See FIGS. 7 and 11.) This gear 72 has a pitch diameter appproximately equal to the outer diameter of the form roller 51 and is able to rotate separately form the form roller 51. The gear for driving the cylinders-for-printing 72 is, as shown in detail in FIG. 7, connected to the worm gear 13 of one of the worm reduction gears 10 of the drive mechanism through a timing belt 73 and the differential gear 33 for the adjustment of the vertical register which is the same as that used in the sheet feed mechanism 1.

The cylinders-for-printing replacement unit 43 is provided with a truck 76 having casters 75 beneath a horizontal plate 74, a support body for the cylinders-for-printing 79 having a pair of vertical lateral plates 78 which are provided oppositely on both the right and left sides of a horizontal bottom plate 77 provided right over the horizontal plate 74, a plate cyliner 80, a blanket cylinder 81 and an impression cylinder 82, these three cylinders being held rotatably between both lateral plates 78 of the support body 79. The horizontal plate 74 of the truck 76 and either side of the lateral plates of the support body 79 are connected each other by a vertical communicating plate 83, whereby the support body 79 is fixed integrally over the truck 76.

Figure 8:
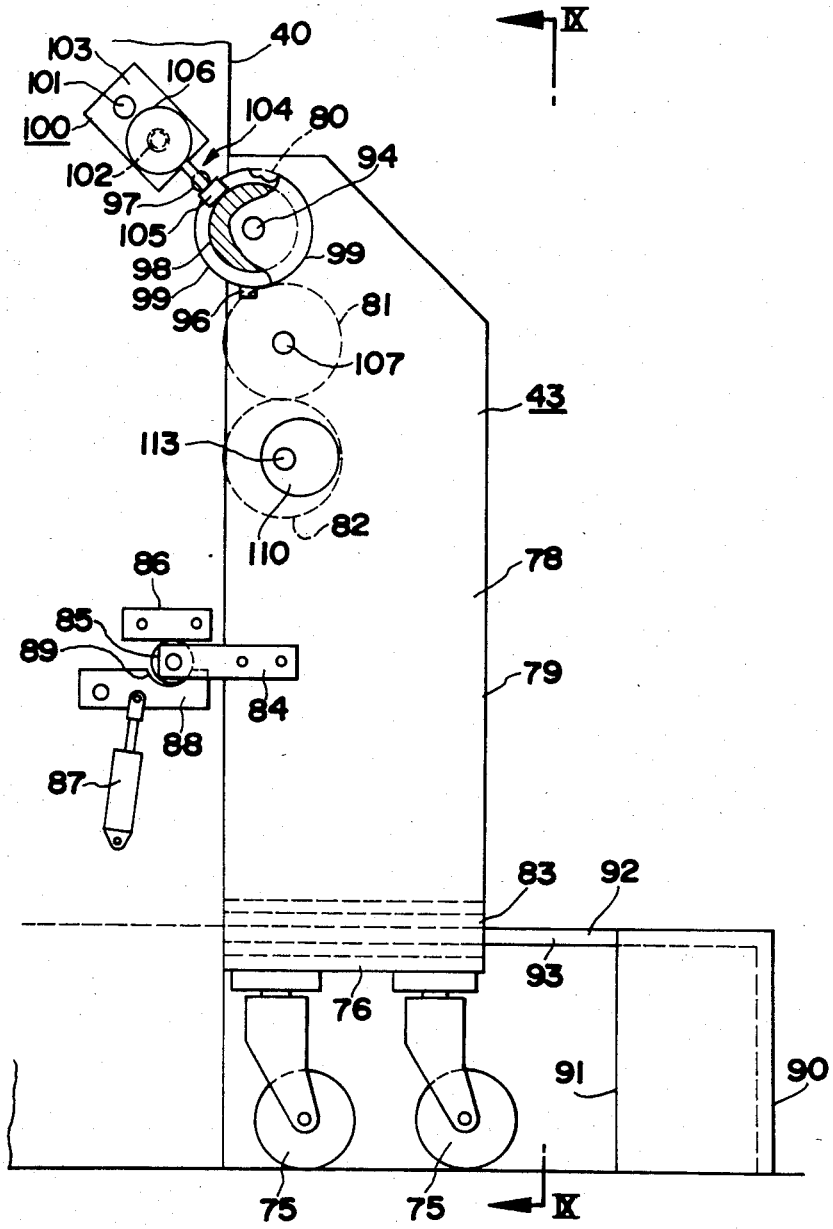
FIG. 8 is an enlarged side view showing a replacement unit in the offset printing mechanism.
Figure 9:
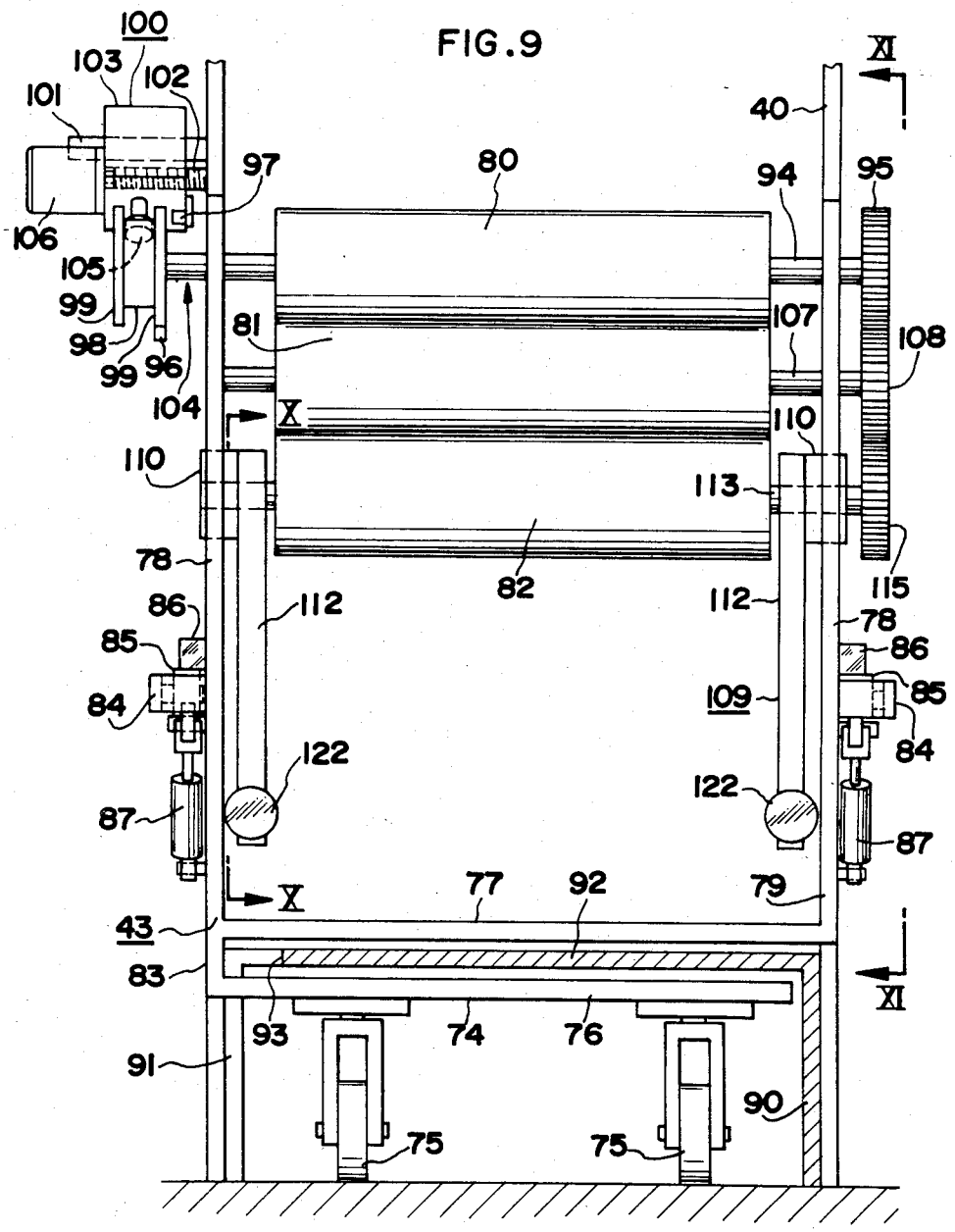
FIG. 9 is a cross-sectional view taken on line IX—IX of FIG. 8.

As shown in FIGS. 8 and 9, on the outer surfaces of both lateral plates 78 of the support body 79, arms 84 projecting rearward are fixed, and rollers 85 are mounted at the rear end portion of each arm 84. On the other hand, on both outer lateral sides of the corresponding frame 40, oscillating arms 88 which move vertically by the horizontal fixtures 86 and an air cylinder 87 are provided vertically, and at the upper side of a place nearer to the oscillating end portion of each arm is provided a semicircular notch 89 having an inner diameter which is slightly larger than the outside diameter of a roller 85. The cylinders-for-printing replacement unit 43 is fixed to the frame 40 in such a manner as will be mentioned hereinafter. That is, by using the casters 75, the replacement unit 43 is moved slightly forward of the frame 40 from the direction of either lateral side first, and when the rear end surfaces of both lateral plates 78 contact to the front end surfaces of the frame 40, the replacement unit 43 is moved rearward in such a manner that the rollers 85 on both sides enter between the fixtures 86 of the frame 40 and the oscillating arms 88 moving downward, then by moving the arms 88 upward and nipping the rollers 85 between the front portion of each notch 89 and each fixture 86, the replacement unit 43 is fixed. In this way, both lateral plates 78 of the support body 79 are pressed and made to contact to the front end surface of the frame 40, and at the same time the entire replacement unit 43 is raised a little, and the replacement unit 43 is usually fixed at a limited position of the front portion of the frame 40. The replacement unit 43 can be detached from the frame 40 through a reverse order of procedure of what mentioned above. On either of vertical lateral plates 91 which are provided on both the right and left sides of a bed 90 which is provided beneath the frame 40 and a horizontal top plate 92, a notch 93 is provided, which being a necessary minimum in order to avoid the interference by the replacement unit 43 when the unit moves right and left, and forward and rearward in mounting and detaching operations of the replacement unit 43. It is constructed that the top plate 92 of the bed 90 is located between the horizontal plate 74 of the truck 76 and the horizontal bottom plate 77 of the support body for the cylinders-for-printing 79 when the replacement unit 43 is put forward of the frame 40.

The plate cylinder 80 is, as shown in detail in FIGS. 7–9 and 11, fixed to a revolving shaft 94 held by both lateral plates 78 of the support body for the cylinders-for-printing 79 rotatably and movably right and left. At the top portion of the revolving shaft 94 projecting outward from one of the vertical lateral plates 78, a gear 95 of a diameter approximately the same as the outer diameter of the plate cylinder 80 is fixed. The plate cylinder 80 contacts to two form rollers 51, 52 which are at the operational positions with a prescribed pressure, and at the same time, a gear 95 of the plate cylinder 80 comes to engage with the gear 72 for driving the cylinders-for-printing of the frame 40. Also, at the top portion of the revolving shaft 94 projecting outward from the other lateral plate 78, a short cylinder 98 is fixed. At both end portions on the right and left sides, a pair of collars 99 of a diameter approximately the same as the outer diameter of the plate cylinder 80 are formed integrally. A projection 96 is formed at a plate on the outer periphery of one of the collars.

A transverse travelling device 100 is attached to the frame 40 of the offset printing mechanism 2 in order to permit the plate cylinder 80 to move a little right and left when required. (See FIGS. 8 and 9.) The transverse travelling device 100 comprises a guide bar 101 which is fixed to the frame 40 and projecting outward and horizontally in the directions of the right and left, a feed screw 102 which is held rotatably by the frame 40 so as to be in parallel to the guide bar 101, a travelling block 103 into which a guide bar 101 is inserted movably right and left and a feed screw 102 engages, a roller 105 which is provided at the top portion of the shaft fixed to the block 103 movably and enters between both collars 99 of the short cylinder 98, and a servomotor for driving the feed screw 106 which is controlled by the control unit 7. The outer diameter of the roller 105 is a little smaller than the distance between both collars 99. The motor 106 rotates by the numerical control or by the control by the manual operational switch to move the travelling block 103 and the roller 105 right and left. As a result, the plate cylinder 80 also moves right and left. The position in the directions of the right and left of the plate cylinder 80 is numerically indicated in the control unit 7. At the top portion of the arm fixed to the travelling block 103 is provided a proximity switch 97 which corresponds to the projection 96 of the collar 99. These components form a rotational angle detecting device 104 of the plate cylinder 80.

The blanket cylinder 81 is, as shown in detail in FIGS. 7–9 and 11, fixed to a revolving shaft 107 held rotatably by both lateral plates 78 of the support body 79 for the cylinders-for-printing. A gear 108 having a pitch diameter approximately equal to the outer diameter of the blanket cylinder 81 is fixed to one end portion of the revolving shaft 107 to engage always with the gear 95 of the plate cylinder 80.

Figure 10:
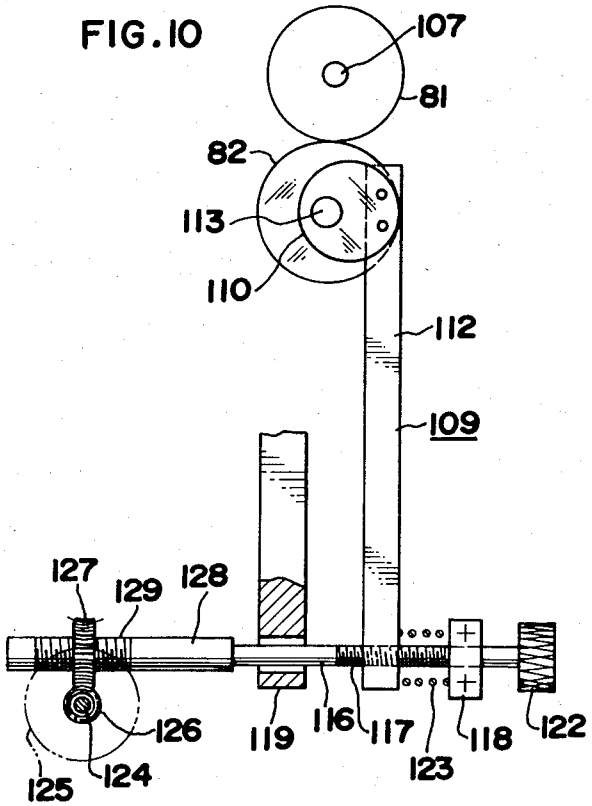
FIG. 10 is an enlarged sectional view taken on line X—X of FIG. 9.

The impression cylinder 82 is, as shown in detail in FIGS. 6, 9 and 10, mounted between both lateral plates 78 of the support body 79 for the cylinders-for-printing through an adjustment device for the impression cylinder 109. The adjustment device for the impression cylinder 109 is used to adjust the wheel base between the blanket cylinder 81 and the impression cylinder 82 correspondingly when the paper thickness of the web 14 changes, and it is constructed as follows. That is, disc-shaped eccentric members 110 are rotatably held in the respective circular holes formed on both lateral plates 78, and each upper end portions of arms for rotating the eccentric members 112 which are extendable upward and downward is fixed on the inner surface of each member 110. At an eccentric position by a prescribed distance from the core of each eccentric member 110, both end portions of the revolving shaft 113 are held, and the impression cylinder 82 is fixed to this revolving shaft 113. A gear 115 having a pitch diameter approximately equal to the outer diameter of the impression cylinder 82 is fixed to the top portion of the revolving shaft 113 projecting outward from one of the eccentric members 110 and engages with the gear 108 of the blanket cylinder 81. At the lowermost end portion of each of the arms for rotating the eccentric members 112, a male screw portion 117 formed at an intermediary region of an adjusting rod 116 extendable forward and downward is held. The front and rear portions of each adjusting rod 116 project forward and rearward through relatively big holes of both guides 118 and 119 fixed on the inner surfaces of the lateral plates 78. At the front end portion of each adjusting rods 116, an adjusting thumb screw 122 is formed integrally. Between the front guide 118 and the arm 112 of each adjusting rod 116, a compression coil spring 123 which usually encourages the lowermost end portion of the arm 112 backward is inserted. On the other hand, at the lower portion of the frame 40, a shaft 124 extendable right and left is held rotatably and one end portion of the shaft 124 is connected to the servomotor for adjusting the impression cylinder 125. Worms 126 are provided at two places on both the right and left sides of the shaft 124, and two worm gears 127 engaging with these worms 126 are held rotatably to the frame 40. A female screw portion is formed at the central region of each worm gear 127, and a male screw portion 129 formed at each intermediary region of two push rods 128 extendable forward and downward engages with each female screw portion. Each push rod 128 is held to the frame 40 rotatably and movably forward and backward. The push rods 128 on both the right and left sides synchronize with each other by the rotation of the motor 125 to move forward and backward. When the cylinders-for-printing replacement unit 43 is fixed to the frame 40, the rear end surface of each adjusting rod 116 is pressed to the front end surface of the corresponding push rod 128 by each compression coil spring 123. At this state, the motor 125 rotates, the two push rods 128 move forward and backward, the adjusting rods 116 move forward and backward and the arms 112 and the eccentric members 110 rotate. As a result, the revolving shaft 113 of the impression cylinder 82 moves upward and downward with the core of the eccentric members 110 being the core of rotation, and the wheel base between the revolving shaft 107 of the blanket cylinder 81 and the revolving shaft 113 of the impression cylinder 82 changes. There is a certain relationship between the wheel base and the amount of travel of the push rods 128, namely the amount of rotation of the motor 125. The control unit 7 memorizes the relations between the paper thickness and the wheel base, namely the amount of rotation of the motor 125, and it rotates the motor 125 by the amount corresponding to the paper thickness set in the control unit 7 when the automatic adjusting button is turned on, and adjusts the wheel base automatically. It is also possible to adjust the wheel base mentioned above by a numerical control. It is possible to change the automatically-adjusted wheel base as mentioned above by a numerical control before starting the operation or during the operation.

Figure 12:
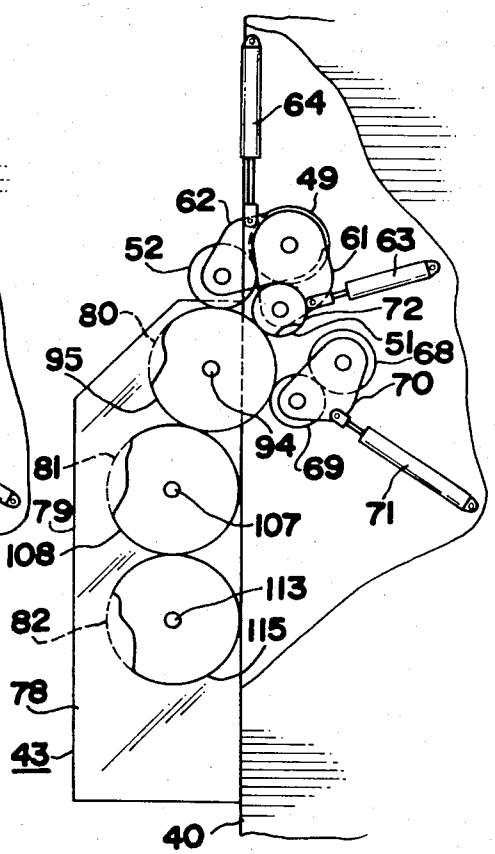
FIG. 12 is a drawing showing another replacement unit in the printing mechanism, different from that shown in FIG. 8, and corresponding to FIG. 11.

This rotary form printing press is provided with a plural number of a cylinders-for-printing replacement units 43, and in use they are replaceable at need. FIG. 12 shows a state in which a replacement unit 43 provided with a plate cylinder 80, a blanket cylinder 81 and an impression cylinder 82, all of which being different in their sizes from those shown in FIG. 11, is fixed to the frame 40. The position of the plate cylinder 80 in each of a plural number of replacement units 43 is determined in such a manner that the replacement unit 43 contacts to two form rollers 51 and 52 with a prescribed pressure which are located at certain operational positions when the replacement unit 43 is fixed to the frame 40. A gear 95 having a pitch diameter approximately equal to the outer diameter of the plate cylinder 80 is fixed to the revolving shaft 94 of the plate cylinder 80, while gears 108 and 115 having a pitch diameter approximately equal to the outer diameter of each cylinder 81, 82 are fixed to the revolving shafts 107 and 113 of the blanket cylinder 81 and the impression cylinder 82 respectively. Therefore, even when the replacement unit 43 is replaced, the plate cylinder 80 comes to contact to two form rollers 51 and 52 which are in their operational positions with a prescribed pressure only by fixing a new replacement unit 43 which is to be used at a prescribed position of the frame 40 as mentioned above, and at the same the gear 95 comes to engage with the gear 72 for driving the cylinders-for-printing. Accordingly, there is no necessity of adjusting by changing the positions of form rollers each time the size of the plate cylinder changes as used to be in conventional form printing presses. When the contact pressure between the plate cylinder 80 and the form rollers has changed due to the abrasion of the form rollers 51 and 52, the contact pressure is adjusted by moving the form rollers 51 and 52 a little by air cylinders 63 and 64. Also when the size of the plate cylinder 80 is changed by replacing the replacement unit 43, it is constructed that the uter diameter of the collars 99 is made approximately equal to that of the plate cylinder 80 so that the roller 105 of the transverse travelling device 100 might enter between the collars 99 of the short cylinder 98 fixed to the revolving shaft 94, and at the same time the roller 105 is made to enter between the collars 99 from the side of the form roller 51.

In the offset printing mechanism 2, the rotation of the worm gears 13 in the worm reduction gears 10 is transmitted to the gear 72 for driving the cylinders-for-printing 72 as well as to the inking arrangement 41 and the dampening arrangement 42 through the differential gear 33 and the timing belt 73. The rotation of the gear 72 is further transmitted to the plate cylinder 80, the blanket cylinder 81 and the impression cylinder 82 through gears 95, 108 and 115.

In cleaning the inking arrangement 41, the ink ductor 48 is made to contact to the ink fountain roller 45 and the ink distributing roller 49 simultaneously by separating two form rollers 51 and 52 from the plate cylinder 80 by air cylinders 63 and 64 and by moving the change-over lever 55 clockwise in FIG. 6 by the air cylinder 59 for driving the change-over lever. With all rollers 45, 48 to 52 rotating at such a state, a cleaning liquid is fed from the nozzle 53 to these rollers. The cleaning liquid is spread to all the rollers 45, 48 to 52 of the inking arrangement 41 ranging from the ink fountain roller 45 to form rollers 51 and 52 because of the ink ductor 48 contacting to both the ink fountain roller 45 and the ink distributing roller 49 simultaneously, and all these surfaces are cleaned. Therefore, in this inking arrangement, it is not necessary to clean the ink fountain roller separately as in a conventional inking arrangement wherein the ink ductor contacts to the ink fountain roller and the ink distributing rollers alternately.

In operation, two form rollers 51 and 52 are positioned at their operational positions and made to contact to the plate cylinder 80, and at the same time the lever for the ink ductor 57 is made to oscillate by the air cylinder 60 for driving the lever for the ink ductor with the change-over lever 55 being moved counterclockwise in FIG. 6 to make the ink ductor 48 to contact to the ink fountain roller 45 and the ink distributing roller 49 alternately. The web 14 fed from the sheet feed mechanism 1 to the offset printing mechanism 2 passes a roller 130 held by the frame 40, then passes between the blanket cylinder 81 and the impression cylinder 82, and in the meantime the printing is performed and the web is fed to the back-carbonizing mechanism 3.

Figure 13:
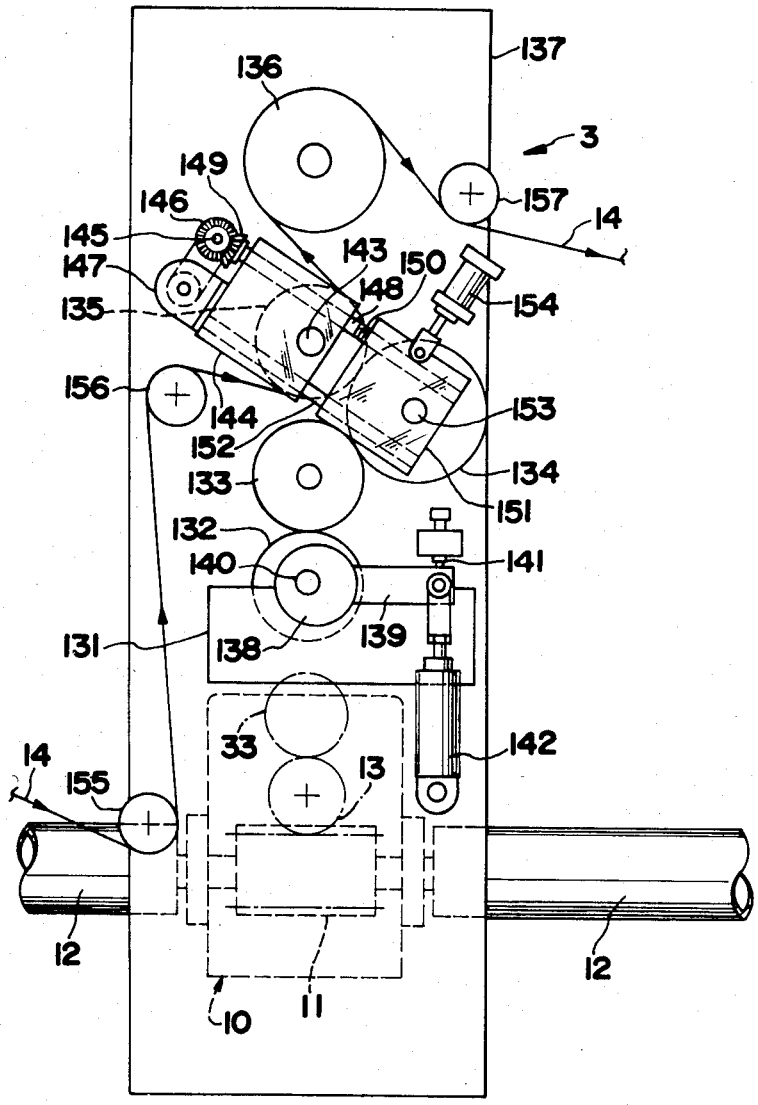
FIG. 13 is a vertical section of the back-carbonizing mechanism.

The back-carbonizing mechanism 3 comprises, as shown in detail in FIG. 13, an ink tank 131, a primary roller 132, an anilox roller 133, a plate cylinder 134, an impression cylinder 135 and a cooling roller 136.

Both end portions on the right and left sides of the anilox roller 133 are held rotatably by a frame 137.

The primary roller 132 is attached to the frame 137 in the following manner. That is, dis-shaped eccentric members 138 are rotatably inserted in the circular holes formed both on the right and left sides of the frame 137, and the rear end portions of the arms 139 extending substantially horizontally from the back to the forth are fixed to each member 138. Both end portions on the right and left sides of a revolving shaft 140 are held at a little eccentric positions with respect to the core of each eccentric member 138, and the primary roller 132 is fixed to the revolving shaft 140. An adjusting stopper 141 contacting to the upper surfaces of the front end portions of the arms 139 is provided on the frame 137, and an air cylinder 142 is provided between the front end portions of the arms 139 and the bottom of the frame 137. The arms 139 are pushed onto the stopper 141 by the air cylinder 142, and the wheel base between the primary roller 132 and the anilox roller 133 can be adjusted by moving the stopper 141 slightly upward and downward to move the arms 139 and the eccentric members 138 a little.

The impression cylinder 135 is fixed to a revolving shaft 143 which both end portions are held by the frame 137. Blocks 144 are rotatably mounted to both end portions of the revolving shaft 143, and a revolving shaft 145 which is extendable right and left is provided between these blocks 144. Bevel gears 146 are provided at two places on the revolving shaft 145, and a servomotor 147 connected to one end portion of the revolving shaft 145 is mounted to one of the blocks 144. The intermediary portions of feed shafts 148 which penetrate each block are mounted to each block 144 rotatably but incapably of moving in the axial direction, and bevel gears 149 provided on one end portion of each feed shaft 148 engage with two bevel gears 146 on the revolving shaft 145. The male screw portions 150 formed at another end portions of each feed shaft 148 screws on the female screw portions formed in the support blocks 151 for the plate cylinder, and guide bars 152 which are fixed to these blocks 151 in parallel to the feed shafts 148 are inserted movably in the guide holes provided on the blocks 144 on the impression cylinder 135. Both end portions on the right and left sides of a revolving shaft 153 are held rotatably and movably right and left by the support blocks 151 for the plate cylinder, and the plate cylinder 134 is fixed to the revolving shaft 153. The support blocks 151 for the plate cylinder move in the approaching and separating directions with respect to the blocks 144 provided on the impression cylinder 135 side due to the rotations of the motor 147. As a result, the wheel base between the impression cylinder 135 and the plate cylinder 134 changes. The wheel base can be adjusted in the same manner as in the case of the adjustment device for the impression cylinder 109 of the offset printing mechanism 2. An air cylinder 154 is provided between the support blocks 151 for the plate cylinder and the frame 137, and the plate cylinder 134 contacts to the anilox roller 133 by the cylinder 154 with a prescribed pressure. Although the illustration is omitted, a gear having a pitch diameter approximately equal to the outer diameter of the impression cylinder 135 is fixed to the revolving shaft 143 of the impression cylinder 135, and at the same time a gear having a pitch diameter approximately equal to the outer diameter of the plate cylinder 134 is fixed to the revolving shaft 153 of the plate cylinder 134. These gears engage each other. A same transverse travelling device of the plate cylinder and a rotational angle detecting device as those provided in the offset printing mechanism are provided at one end portion of the revolving shaft 153 of the plate cylinder 134 and in one of the support blocks 151 for the plate cylinder. This rotary form printing press is provided with a plural number of plate cylinders 134, the dimensions thereof being different, and they are available for use in accordance with the necessity.

Both end portions of the cooling roller 136 are held rotatably by the frame 137. The cooling roller 136 is of a hollow cylindrical shape with both ends closed, and a plurality of spraying holes for the cooling air (not shown) are formed all over the circumferential wall. It is constructed that the cooling air supplied into the cooling roller 136 by proper means is sprayed from these holes.

The rotation of the worm gears 13 of the worm reduction gears 10 of the driving device is transmitted to the primary roller 132, the anilox roller 133, the plate cylinder 134, the impression cylinder 135 and the cooling roller 136 through the differential gear 33 for adjusting the vertical register of the same construction as mentioned above, gears and the timing belt. Rollers 155, 156 and 157 are held rotatably by the frame 137, and the web 14 fed from the offset printing mechanism 2 to the back-carbonizing mechanism 3 passes the rollers 155 and 156, then passes between the plate cylinder 134 and the impression cylinder 135, and further passes the cooling roller 136 and the roller 157 to be fed to the processing machine 4.

Figure 14:
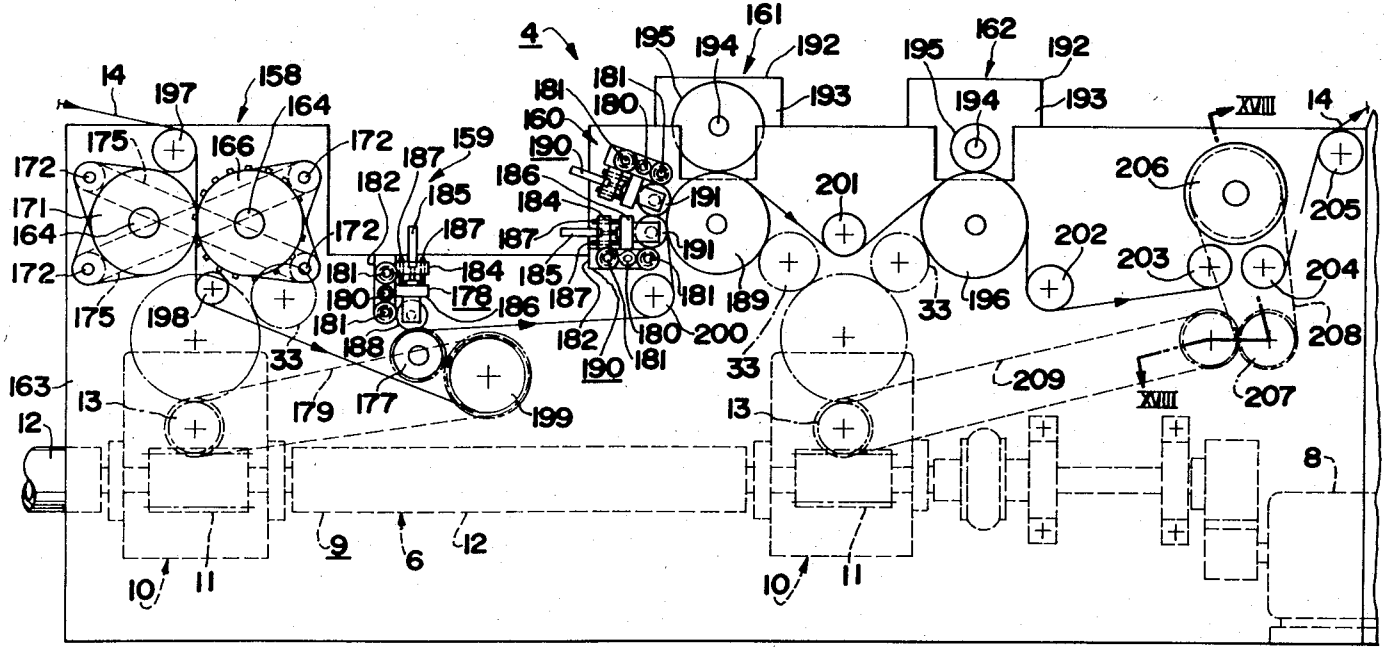
FIG. 14 is a vertical section of the processing machine.

As shown in FIG. 14, the processing machine 4 is provided with a punching unit 158, a slitter 159, a vertical perforation unit 160, a first cross perforation unit 161 and a second cross perforation unit 162 in these orders.

Figure 15:
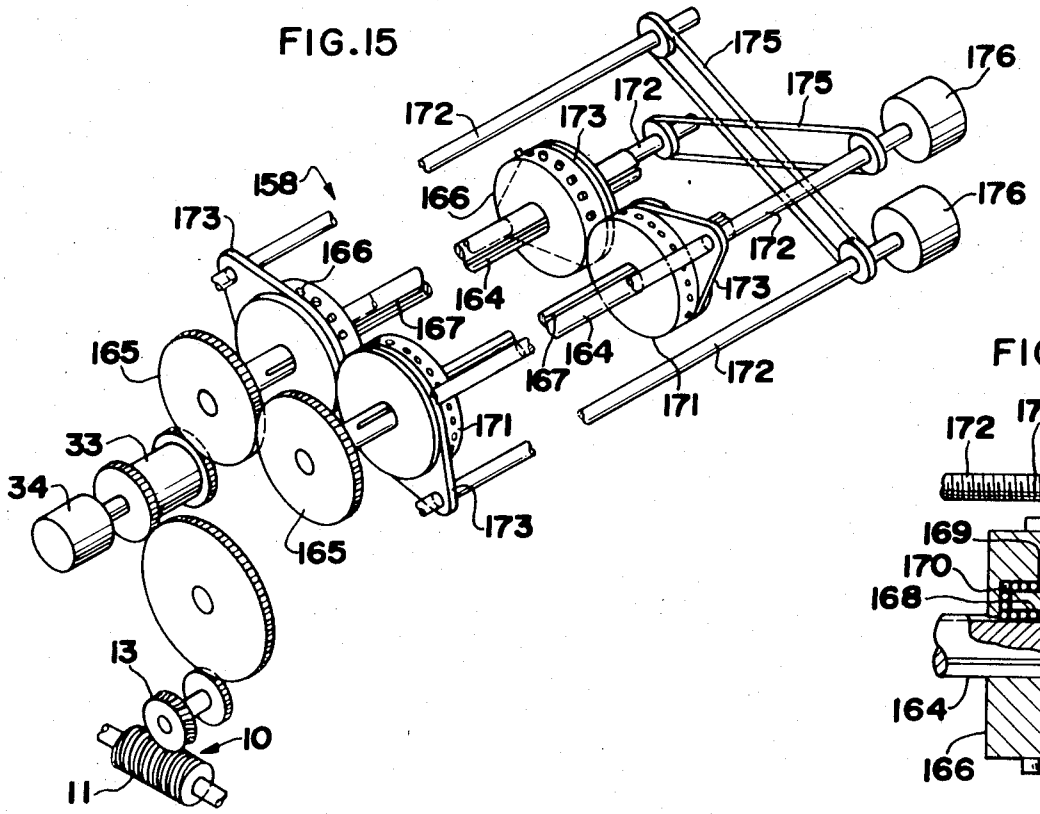
FIG. 15 is a partially omitted perspective view of the punching unit.

The punching unit 158 is for punching feed holes on both the right and left sides of the web 14. The details thereof are shown in FIG. 15. Both end portions on the right and left sides of two revolving shafts 164 provided in parallel to each other are held by a frame 164 of the processing machine 4. Gears 165 engaging with each other are fixed at the top portions projecting outward from the frame 163 of the revolving shafts 164, and one of the gears 165 is connected to the worm gear 13 of the reduction gears 10 of the drive mechanism through the same differential gear 33 for adjusting the vertical register as mentioned above. A same rotational angle detecting device asd used in the offset printing mechanism 2 is provided at one end portion of one of the revolving shafts 164 and on either side of the frame 163, the illustration thereof being omitted.

Figure 16:
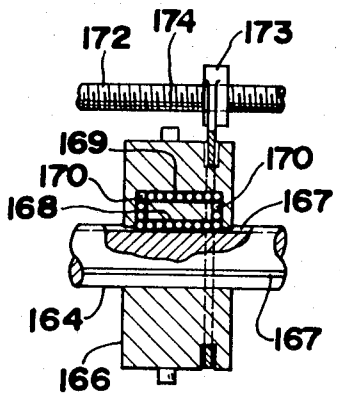
FIG. 16 is a vertical section of a pin wheel in the punching unit.

On both the right and left sides of one of the revolving shaft 164, two pin wheels 166 are mounted. As shown in FIG. 16, three channels 167 having a semicircular-shaped cross section extending in the axial direction are formed at equal spaces on the outer peripheral surface of the revolving shaft 164. On the other hand, three channels 168 having a semicircular shaped cross section which correspond to the channels 167 are formed at places on the inner surfaces of the holes on the pin wheels 166 wherein the revolving shafts 164 are inserted except for both end portions on the right and left sides of the inner surfaces. Holes 169 communicating both end portions of each channel 168 are provided in the pin wheels 166. A plurality of steel balls 170 are housed capably of circulating in three annular spaces limited by these channels 167, 168 and holes 169. By such a construction, the pin wheels 166 can move smoothly in the longitudinal direction, namely right and left of the revolving shafts 164 without rotating with respect to the revolving shafts 164. Two pin wheels 166 and two die wheels 171 provided correspondingly to two pin wheels respectively and forming a pair are respectively mounted to the other revolving shaft 164 in such a manner as mentioned above.

Both end portions on the right and left sides of four feed shafts 172 provided in parallel to the revolving shafts 164 are rotatably held by the frame 163, and wheels 166 and 171 are connected to each feed shaft 172 through travelling members 173. That is, travelling members 173 are mounted to the wheels 166 and 171 rotatably but incapably of moving right and left. One end portion of the travelling members 173 screws on the male screw portion 174 formed on the feed shafts 172. (See FIG. 16.) Each one end portion of two feed shafts 172 connected to either pair of the pin wheel 166 and the die wheel 171 is connected togehter by one of the timing belts 175, and servomotors 176 for adjusting the positions are connected to one of these feed shafts 172. A pair of pin wheel 166 and die wheel 171 as mentioned above travel right and left simultaneously along the revolving shafts 164 due to the rotation of one of these motors 176. The same applies to another pair of pin wheel 166 and die wheel 171. By these two motors 176, the positions of two pairs of wheels 166 and 171 in the directions of right and left can be adjusted separately, and the positions of each pair of wheels 166 and 171 in the directions of right and left are numerically indicated in the control unit 7. The adjustment of the positions can be performed by the numerical control or by the control by a manual operational switch or automatically by pushing the automatic adjusting button before starting the operation in the following manner. That is, the positions of two pairs of wheels 166 and 171 are previously set in the control unit 7, and when the automatic adjusting button is pushed, each pair of wheels 166 and 171 travel of this position to stop there. It is also possible to change the positions thus adjusted automatically by the numerical control or by the control by a manual operational switch before starting the operation or during the operation. When no punching-processing is required, two pairs of wheels 166 and 171 are made to move to both end portions on the right and left sides of the revolving shafts 164. The positions of two wheels 166 and 171 are set in the control unit 7 each time they change. Since the positions of two pairs of wheels 166 and 171 are decided in accordance with the kind of business forms to be printed, it is possible to make the control unit 7 to memorize the positions correspondingly to the kind of business forms and to set the positions automatically by selecting the kind of business forms.

The slitter 159 is used to cut down both marginal portions on the right and left sides of the web to true up the paper thickness. As shown in FIGS. 14 and 17, this device 159 is provided with a receiving cylinder 177 which both end portions are rotatably held by the frame 163 and two processing heads 178. The receiving cylinder 177 is connected to the worm gear 13 of the reduction gear 10 of the drive mechanism which is common to the punching unit 158 through a timing belt 179.

Both end portions of a guide bar 180 extendable right and left are fixed to the frame 163 of the processing machine 4, and at the same time both end portions of two feed screws 181 disposed above and below the bar in parallel to each other are held rotatably by the frame. Servomotors for adjusting the positions (not shown) are connected to one end portion of each feed screw 181. Travelling members 182 of the two processing heads 178 on the right and left sides are inserted in the guide bar 180. As shown in FIG. 17, the lower feed screw 181 screws on the female screw portion provided at a lower part of one of the travelling member 182, and at the same time the upper feed screw 181 is inserted with a slight space in the penetrating hole 183 provided at an upper part of the travelling member. This travelling member 182 travels right and left without being subjected to the interference by the upper feed screw 181 owing to the rotation of the lower feed screw 181, and it does not travel even when the upper feed screw 181 rotates. To the contrary, the travelling member on the opposite side 182 can travel right and left owing to the rotation of the upper feed screw 181 without being subjected to the interference by the lower feed screw 181, but it does not travel even when the lower feed screw 181 rotates. Therefore, as in the punching unit 158, it is possible to adjust separately the positions in the direction of the right and left of the processing heads 178 by two motors.

A square-shaped block 184 projecting forward is fixed at a front portion of the upper part of the travelling member 182 of each processing head 178, and a downward air cylinder 185 is fixed to the upper surface of this block 184. A holder 186 which is movable upward and downward along the front surface of the travelling member 182 is fixed to the lowermost end portion of the rod of this cylinder 185 which, penetrating the block 184, projects downward, and two guide bars 187 fixed upward to the upper surface of the holder 186 are inserted in the guide holes formed in the block 184 movably upward and downward. At the lowermost end portions of each holder, a cutter 188 is rotatably mounted. When a slitting-processing is performed, the cutter 188 is pressed to the receiving cylinder 177 by lowering the holder 186 by the air cylinder 185, and when no slitting-processing is required, the holder 186 is raised to allow the cutter 188 to be positioned above and apart from the receiving cylinder 177.

The position of two processing heads 178 of the slitter 159 in the directions of the right and left can be adjusted in the same manner as in the punching unit 158. In the case of the slitter 159, however, every processing head 178 is set as to whether any slitting-processing is required or not besides of the position of each head in the directions of the right and left, and so the control unit 7 controls the air cylinder 185 automatically when the automatic adjusting button has been pushed.

The vertical perforationunit 160 is to perform the vertical perforation processing on the web 14. As shown in FIG. 14, this unit 160 is provided with a receiving cylinder 189 which both end portions on the right and left sides are held rotatably by the frame 163 and four processing heads 190 which are movable right and left. The receiving cylinder 189 is connected to the worm gear 13 of one of the reduction gear 10 of the drive mechanism through the differential gear 33 for adjusting the vertical register which is of the same construction as that mentioned above. The processing heads 190 are of the same construction as that of the slitter 159, and a like numeral refers to a like component. The processing heads 190 are mounted to two guide bars 180 by two, and servomotors for adjusting the position (not shown) are connected to four feed screws 181 respectively. As in the slitter 159, the positions of four processing heads 190 can be adjusted in the directions of the right and left separately by these four motors. To the top end portion of the holders 186 of the processing heads 190, vertical perforation cutters 191 are rotatably mounted. It is possible to push only required cutters 191 on the receiving cylinder 189, and cutters not required are allowed to be positioned apart from the receiving cylinder 189.

The first cross perforation unit 161 is to apply the web 14 the cross perforation processing transversely at prescribed spaces. As shown in FIG. 14, this unit 161 comprises the receiving cylinder 189 which is common to the vertical perforation unit 160 and a perforation cylinder replacement unit 192 which can detachably be mounted to the upper portion of the frame 163. Both end portions on the right and left sides of a revolving shaft 194 are held rotatably by both lateral plates 193 of the replacement unit 192. A perforation cylinder 195 is fixed to this revolving shaft 194. The rotation of the receiving cylinder 189 is transmitted to the perforation cylinder 195 by gears. Across perforation cutter which is extendable right and left is fixed at a place on the outer surface of the perforation cylinder 195. Rotational angle detecting devices of the same construction as that mounted in the offset printing mechanism 2 are provided at one end portion of revolving shaft 194 of the perforation cylinder 195 and on a lateral plate 193. Illustrations of the details of these structures are omitted.

The second cross perforation unit 162 comprises a receiving cylinder 196 which both end portions on the right and left sides are held rotatably by the frame 163 and the perforation cylinder replacement unit 192 of the same construction as that mentioned above. The receiving cylinder 196 is connected to the worm gear 13 of one of the reduction gear 10 of the drive mechanism which is common to the vertical perforation unit 160 and the first cross perforation unit 161 through a differential gear 33 for adjusting the vertical register of the same construction as that mentioned above. The remaining components are the same as those in the first cross perforation unit 161, and a like numeral refers to a like component.

This rotary form printing press is provided with a plural number of replacement units 192 having perforation cylinders 195 of different dimensions, and they are replaceable for use in accordance with the necessity. When two kinds of cross perforation processing are required, replacement units 192 are mounted at prescribed positions of both cross perforation units 161 and 162, as shown in FIG. 14. When only a single kind of cross perforation processing is required, a replacement unit 192 is mounted to either of the cross perforation unit 161 or 162. When no cross perforation processing is required, the replacement unit 192 is kept detached from both cross perforation units 161 and 162.

A plural number of rollers 197, 198, 199, 200, 201, 202, 203, 204 and 205 and a receiving rollers 206 are rotatably held by the frame 163 of the processing machine 4, and the web 14 fed from the back-carbonizing mechanism 3 passes the roller 197, the punching unit 158, rollers 198, 199, the receiving cylinder 177 of the slitter 159, the roller 200, the receiving cylinder 189 of the vertical perforation unit 160 and the first cross perforation unit 161, the roller 201, the receiving cylinder 196 of the second cross perforation unit 162, the rollers 202 and 203, the receiving roller 206 and rollers 204 and 205, then it is fed to the delivery machine 5.

The receiving roller 206 is for receiving the processed web 14 with a prescribed tension and feeding it to the delivery machine 5. The receiving roller 206 is, as shown in FIGS. 14 and 18, connected to the worm gear 13 of one of the reduction gear 10 of the drive mechanism which is common to the perforation units 160, 161 and 162 through a slipping device 207 wherein an electromagnetic clutch or a torque converter is used and timing belts 208 and 209. The receiving roller 206 is of a hollow cylindrical shape with its both ends on the right and left sides closed, and a plurality of holes 210 are provided all over its peripheral wall. The inner space of the receiving roller 206 is connected to a vacuum device (not shown in the drawings) wherein a ventilator or the like is used by proper means, whereby said space is kept at a vacuum state. The web 14 which has passed the roller 203 contacts close around the surface of the receiving roller 206 by the vacuum device, and it is sent out to the delivery machine 5 at a prescribed tension without slipping. A conventional receiving roller is directly connected to a drive mechanism by gears or the like and rotates always at a prescribed velocity. Therefore, when the paper thickness changes to generate a difference between the travelling velocity of the paper and the surface velocity of the receiving roller, a slipping is generated between the paper and the receiving roller, and the tension of the paper varies. To the contrary, the receiving roller 206 according to the present invention is connected to the drive mechanism 6 through the slipping device 207, so even in such a case, the slipping is generated in the slipping device 207, and no slipping is generated between the paper 14 and the receiving roller 206. Therefore, the tension of the web 14 does not vary as used to be conventionally, and any resulting expansion and contraction of the web 14 are not generated, so that there is no danger of generating errors in the vertical register at the positions to be printed or to be processed. Since the tension of the web 14, namely the rotation torque of the receiving roller 206 changes according to the paper thickness, the control unit 7 memorizes the relations between the paper thickness and the rotation torque. The set torque of the slipping device 207 is changed according to the paper thickness which has been set in the control mechanism 7 by pushing the automatic adjusting button before starting the operation. It is possible to set the torque in the slipping device 207 by the numerical control. It is also possible to change the automatically-set torque by the numerical control before starting the operation or during the operation. Moreover, since the paper 14 contacts close to the surface of the receiving roller 206 by the vaccum device and there is no necessity of pushing the paper against the receiving roller by a pushing roller, there is no danger that the printed surface of the paper is made dirty by the pushing roller.

The delivery machine 5 is provided with a zig-zag folding unit 211 and a winder 212. Either of them is used according to the use.

Figure 19:
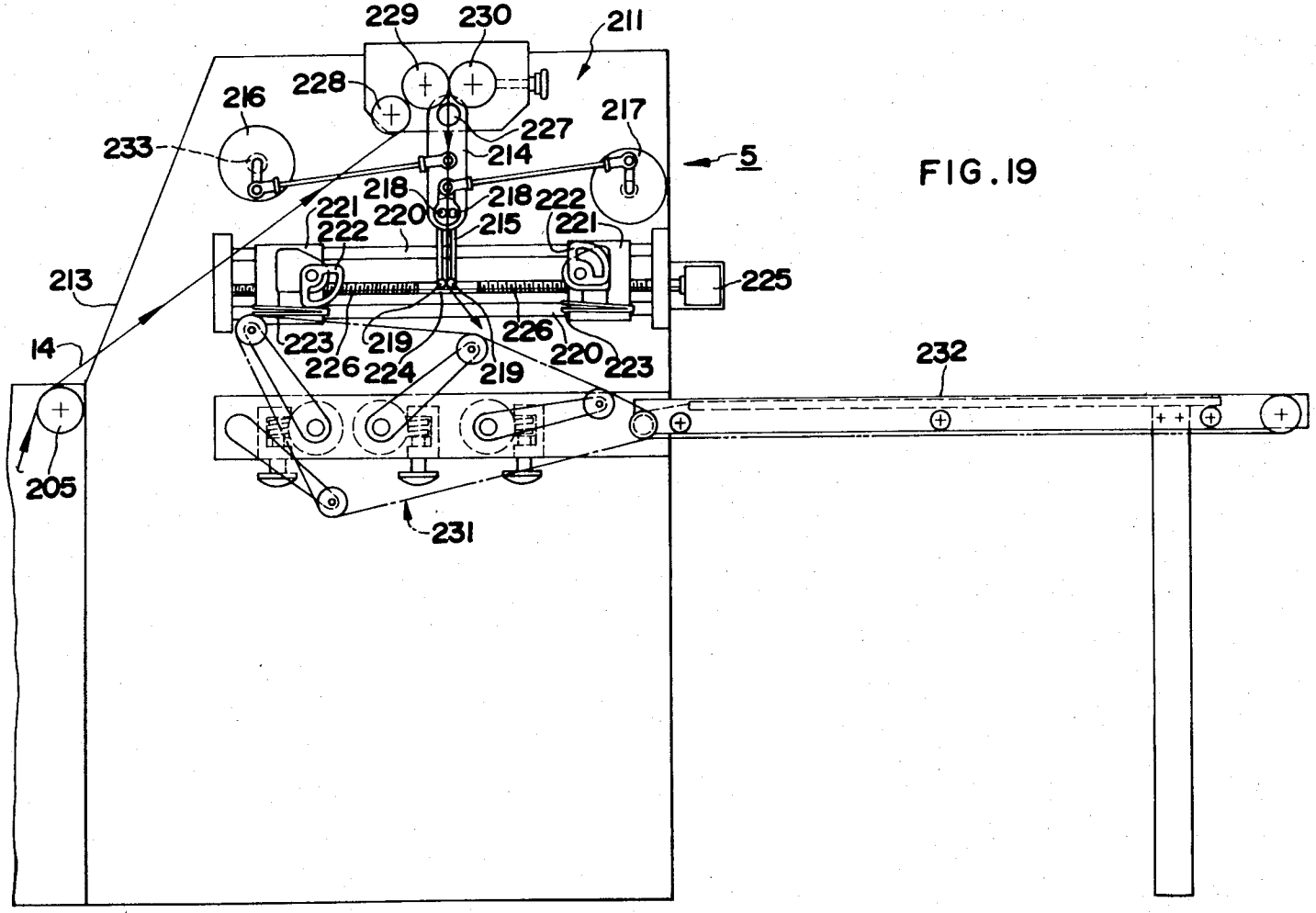
FIG. 19 is a vertical section of the zig-zag folding unit.

The zig-zag folding unit 211 is for folding the paper 14 fed from the processing machine 4 zigzag at the position of the cross perforation and piling it, the detail thereof being shown in FIG. 19. The upper end portion of a widely swinging arm 214 is mounted capably of oscillating back and forth to an upper portion of a frame 213 of the delivery machine 5, and at the same time the upper end portion of a narrowly swinging arm 215 is mounted capably of oscillating back and forth to the oscillating lower end portion of the arm 214. Each of the arms 214 and 215 is connected to two crank discs for driving the arms 216 and 217 which are held rotatably by the frame 213. Two-in-a-set rollers 218 and 219 which are extendable right and left are rotatably mounted to the oscillating lower end portions of each of the arms 214 and 215 respectively.

On one lateral side on the right and left side of the frame 213, two horizontal guide bars 220 which are extendable back and forth are provided. One lateral side on the right and left side of two travelling blocks 221 provided in front and in the rear is attached to these guide bars 220 movably back and forth. To each travelling block 221, a plural number of dusters 222 are attached rotatably at prescribed spaces in the directions of the right and left, and at the same time a plural number of spirals 223 provided among these dusters 222 are attached rotatably. A feed shaft 224 is provided between and in parallel to these guide bars 220, and a servomotor for adjusting the positions 225 is connected to one end portion of this shaft 224. Male screw portions 226 which directions differ each other are provided in front and in the rear of the feed shaft 224, and each travelling block 221 screws on each male screw portion 226. The front and rear travelling blocks 221 travel back and forth by the rotation of the motor 225 in such a manner that the blocks approach and be separated each other with the point directly below a central axis of oscillation 227 of the widely swinging arm 214 between. In the control unit 7, the folding width of the paper 14, namely the mutual spaces for cross perforation is set. Therefore, when the automatic adjusting button is pushed before starting the operation, this control unit 7 correspondingly controls the amount of rotation of the motor 225 to adjust the longitudinal spaces of the dusters 222 and spirals 223. The adjustment of these spaces can be performed by the numerical control or by the control by a manual operational switch. It is also possible to change the automatically adjusted spaces by the numerical control or by the control by a manual operational switch.

Crank discs for driving the arms 216 and 217, dusters 222 and spirals 223 are connected to the worm gear 13 of the reduction gear 10 of the drive mechanism common to the perforation units 160, 161 and 162 through a differential gear for adjusting the vertical register of the same construction as mentioned above. A rotational angle detecting device of the same construction as provided in the offset printing mechanism 2 is provided at one end portion of a revolving shaft 233 on which the crank disc 216 is fixed and on one side of the frame 213. At an upper portion of the frame 213, rollers 228, 229 and 230 are held rotatably. The paper 14 which has passed the roller 205 of the processing machine 4 passes among rollers 228, 229 and 230, between rollers 218 of the widely swinging arm 214, between rollers 219 of the narrowly swinging arm 215, and it is folded zigzag by the oscillation of the arms 214 and 215 and the rotation of the dusters 222 and of the spirals 223 at the position of cross perforation and is piled up, then the piled paper passes a belt conveyer 231 and a delivery conveyer 232 and it is delivered.

The winder 212 is of the same construction as conventional one. Therefore, the illustration and explanation thereof are omitted.

The rotational angle detecting device 104 provided on the revolving shaft 94 of the plate cylinder 80 of the cylinders-for-printing replacement unit 43 and the differential gear 33 provided between the plate cylinder 80 and the drive mechanism 6 are for rotating the plate cylinder 80 to allow it to stop at a desired angular position in order to perform the adjustment of the vertical register. The rotation of the servomotor 34 of the differential gear 33 at a state wherein the drive mechanism remains static permits the plate cylinder 80 to rotate, and the angle detecting device 104 detects the angular position of the plate cylinder 80 by the amount of rotation of the motor 34 from the point on which the proximity switch 97 has detected the projection 96 of the collars 99 when said detected point is assumed as the starting point. The motor 34 of the differential gear 33 rotates by the numerical control from the control unit 7 or by the control by a manual operational switch to stop the plate cylinder 80 at a desired angular position, and the angular position is indicated in the control unit 7. During operation, the motor 34 of the differential gear 33 stops and the rotation of the drive shaft 9 is transmitted to the plate cylinder 80.

The same applies to the rotational angle detecting devices provided on the revolving shaft 153 of the plate cylinder 134 in the back-carbonizing mechanism 3, the revolving shafts 164 of the punching unit 158, the revolving shaft 194 of the perforation cylinder 195 in the cross perforation units 161 and 162 and the revolving shaft 233 of the crank disc 216 in the zigzag folding unit 211, and the differential gear 33 provided among these revolving shafts 153, 164, 194 and 233 and the drive mechanism 6. Actuating these components, the control unit 7 performs the adjustment of the vertical register automatically in the following manner with the punching unit 158 being its basis of register. That is, when the automatic adjusting button is pushed before starting the operation at a state wherein the drive mechanism 6 is kept static, the revolving shafts 164 in the punching unit 158 rotate until they arrive at the starting points to stop there, and at the same time the revolving shafts 94, 153, 194 and 233 of other parts stop at the basic angular positions previously set in the control unit 7. As a result, the registering is performed. The basic angular positions are set separately with respect to each of the revolving shafts 94, 153, 194 and 233. The basic angular position of the crank disc 216 in the zigzag folding unit 211 is always fixed. As for the plate cylinder 80 of the cylinders-for-printing replacement unit 43, every unit 43 has a determined angular position, and as far as a same unit 43 is used, the basic angular position is fixed. Therefore, it is possible to set the previously known basic angular position each time the unit 43 is replaced, or to make the basic angular position to be set automatically first by allowing the control unit 7 to memorize the basic angular positions with respect to each unit 43 then by selecting the number of the units 43. Also, since the unit 43 to be used is determined correspondingly to the determination of the business forms to be printed, it is possible to make the control unit 7 memorize the number and the basic angular position of each unit 43 according to the kinds of business forms, and to adjust the vertical register by selecting the kind of the business form. It is because the basic angular position can be set automatically in this way. The same applies the plate cylinder 134 in the back-carbonizing mechanism 3 and the perforation cylinder replacement unit 192 of the cross perforation units 161 and 162.

As mentioned above, in the rotary form printing press according to the present invention, the adjustment of the rotating speed of the feed roller 20, the adjustment of the wheel base between the respective impression cylinders 82 and 135 of the offset printing mechanism 2 and the back-carbonizing mechanism 3, the adjustment of the set torque of the receiving roller 206, the detection as to whether the processings are required or not and the adjustment of the positions in the directions of the right and left by the punching unit 158, the slitter 159 and the vertical perforation unit 160 in the processing machine 4, the adjustment of the spaces between the dusters 222 and between the spirals 223 in the zigzag folding unit 211 and the adjustment of the vertical register among each part can be performed automatically by pushing the automatic adjusting button before starting the operation, and thereafter the automatic operation can started by pushing the operation-starting switch in the control unit 7. Accordingly, it is not necessary to perform trial-printings and adjustments several times as conventionally used to be, which results in a remarkable shortening of the preparatory time for the operation. It is possible to set separately the paper thickness for these adjustments, the paper thickness for the adjustments, the processings by the punching unit 158, the slitter 159 and the vertical perforation unit 160 and the positions in the directions of the right and left to be processed by them, the folding width of the paper 14 and the basic angular positions of the revolving shafts 94, 153, 194 and 233 according to the necessity and each time they change. It is also possible to set completely automatically by selecting the kind of the business form as mentioned above.

In the rotary form printing press as mentioned above, the rotation of the drive shaft 9 is transmitted to each part through the worm reduction gear 10, as a result, the drive shaft 9 can be rotated at a high speed and low torque. Therefore, the distorsion of the drive shaft 9 is smaller in comparison to a conventional drive shaft which rotates at a low speed and high torque, and yet this distorsion is transmitted to each part at a reduced speed. Consequently, the errors in the vertical register of the positions to be printed or to be processed are minimized.

In the embodiment mentioned above, a rotary offset form printing press has been described. The present invention, however, is also applicable to other kinds of rotary form printing press such as a rotary form letterpress machine.

By the rotary form printing press according to the present invention, the adjustment of the vertical register of the positions to be printed or to be processed, the adjustment of the positions of the wheels 166 and 171 of the punching unit 158, the adjustment of the positions of the processing heads 178 and 190 of the vertical perforation unit 160, the adjustment of the wheel base between the impression cylinder 82 and the plate cylinder 80 contacting to said impression cylinder or between the impression cylinder 82 and the blanket cylinder 81 according to the paper thickness and the adjustment of the rotational speed of the feed roller 20 can be performed automatically, as mentioned above. Therefore, it is not necessary to perform trial printings and adjustments several times as conventionally used to be, which results in a remarkable shortening in the preparatory time for the operation.

What is claimed is:

1. A rotary business form printing press comprising:

the sheet feed mechanism 1 having a feed roller 20 for the web 14, the printing mechanism 2 having the plate cylinder 80 the impression cylinder 82 which contacts to the plate cylinder 80 directly or through the blanket cylinder 81, the punching unit 158 having pin wheels 166 and die wheels 171, the counterparts of the pin wheels, a vertical perforation unit 160 having processing heads 190 provided with vertical perforation cutters 191, cross perforation units 161 and 162 having a perforation cylinder 195, the zigzag folding unit 211, the whole drive mechanism 6 and the control unit 7, wherein the differential gear 33 for controlling the velocity of the feed roller provided with the motor 34 which speed control is performed by the control unit 7 being provided between the feed roller 20 and the drive mechanism 6, an adjustment device for the impression cylinder 109 which adjusts the wheel base between the impression cylinder 82 and the plate cylinder 80 or the blanket cylinder 81 contacting thereto by using the motor 125 controlled by the control unit 7 being provided in the printing mechanism 2, motors for adjusting the positions which are controlled by the control unit 7 and permit the wheels 166, 171 and the processing heads 190 to travel right and left being provided in the punching unit 158 and the vertical perforation unit, rotational angle detecting devices 104 being provided on the revolving shaft 94 of the plate cylinder 80, on the revolving shafts 164 of the wheels 166 and 171 in the punching unit 158, on the revolving shaft 194 of the perforation cylinder 195 and on the revolving shaft 233 for driving the zigzag folding unit 211 respectively, the differential gear 33 for adjusting the vertical register provided with the motor 34 controlled by the control unit 7 being provided between these revolving shafts 94, 164, 194, 233 and the drive mechanism 6, and the control unit 7 having the functions of adjusting:

the rotation speed of the feed roller 20 through the differential gear 33 according to the previously-set paper thickness, the wheel base between the impression cylinder 82 and the plate cylinder 80 or the blanket cylinder 81 contacting thereto through the adjustment device for the impression cylinder 109 according to the previously-set paper thickness, the positions of the wheels 166, 171, in the punching unit 158 and of the processing heads 190 in the vertical perforation unit 160 through said motor for adjustment of position according to the previously-set contents, and the vertical register by making the revolving shafts 94, 164, 194 and 233 of the plate cylinder 80, the wheels 166, 171 in the punching unit 158, the perforation cylinder 195 and the zigzag folding unit 211 respectively to rotate to the previously-set angular position through the differential gear.

2. A rotary business form printing press as set forth in claim 1 wherein the entirety of the driving mechanism 6 comprises the drive shaft 9 which rotates at high speed and worm reduction gears 10 provided at a plural number of places on the drive shaft 9.

3. A rotary business form printing press as set forth in claim 1 wherein a slitter 159 having processing head 178 provided with cutters 188 is provided, and the slitter 159 is provided with motors for adjusting the positions in order to make the processing heads 178 to travel right and left.

4. A rotary business form printing press provided with the sheet feed mechanism 1, the printing mechanism 2 having the plate cylinder 80, the punching unit 158 having pin wheels 166 and die wheels 171, the counterparts of the pin wheels, the cross perforation units 161, 162 having the perforation cylinder 195, the zigzag folding unit 211 and their drive mechanisms 6 wherein the drive mechanism 6 is provided with one drive motor 8, the drive shaft 9 which can rotate at high but fixed speed by the drive motor, and worm reduction gears 10 provided at a plural number of places of the drive shaft 9.

5. A rotary business form printing press as set forth in claim 4 wherein worms 11 of a plural number of reduction gears 10 and a plural number of hollow shafts 12 are alternately connected to form a drive shaft 9 and the drive shaft 9 horizontally extends back and forth.

6. A rotary business form printing press provided with a sheet feed mechanism 1, a printing mechanism 2 having a plate cylinder 80, a punching unit 158 having pin wheels 166 and corresponding die wheels 171, cross perforation units 161 and 162 having a perforation cylinder 195, a zigzag folding unit 211 and their drive mechanisms 6 wherein rotational angle detecting devices 104 are provided on:

a revolving shaft 94 of the plate cylinder 80, revolving shafts 164 of wheels 166, 171 in the punching unit 158, a revolving shaft 194 of a perforation cylinder 195 and a revolving shaft 233 for driving the zigzag folding unit 211, and at the same time a differential gear 33 for adjusting the vertical register having a motor 34 is provided between these revolving shafts 94, 164, 194, 233 and the drive mechanism 6.

7. A rotary business form printing press as set forth in claim 6 wherein a control unit 7 having a function of performing the adjustment of the vertical register by permitting the revolving shafts 94, 164, 194 and 233 to rotate to previously-set angular positions respectively is provided and the motor 34 is controlled by the control unit 7.

8. A rotary business form printing press as set forth in claim 7 wherein the drive mechanisms 6 comprise a drive shaft 9 which rotates at a high speed and worm gears 10 provided at a plural number of places on the drive shaft 9.

9. A rotary business form printing press as set forth in claim 6 wherein a change-over lever 55 attached capably of moving to a frame 40 of the printing mechanism 2, a lever for the ink ductor 57 attached capably of oscillating to the movable end portion of the change-over lever 55 and an ink ductor 48 which is attached to the oscillating end portion of the lever for the ink ductor 57 and positioned between and ink fountain roller 45 and an ink distributing roller 49 are provided, and the ink ductor 48 contacts alternately to the ink fountain roller 45 and to the ink distributing roller 49 while the lever for the ink ductor 57 is oscillating at a state wherein the change-over lever 55 has been changed over to one side, and it contacts to both of the ink fountain roller 45 and the ink distributing roller 49 simultaneously when the change-over lever 55 has been changed over to the other side.

10. A rotary business form printing press as set forth in claim 6 wherein a cylinders-for-printing replacement unit 43 which can be attached detachably to the frame 40 is provided in the printing mechanism 2, said replacement unit 43 comprises a truck 76 having casters 75 and a support body for the cylinders-for-printing 79 fixed integrally on to the truck 76, and at least the plate cylinder 80 and a blanket cylinder 81 or an impression cylinder 82 contacting thereto are attached to the support body for the cylinders-for-printing 79.

11. A rotary business form printing press as set forth in claim 6 wherein the cylinders-for-printing replacement unit 43 which can detachably be attached one by one to a prescribed position of the frame 40 is provided in the printing mechanism 2, two form rollers 51 and 52 which are positioned at prescribed operational positions, and a gear for driving the cylinders-for-printing 72 having a pitch diameter approximately equal to the outer diameter of the form roller 51 and approximately coaxial with the form roller 51 positioned in the operational position are provided on the frame 40 so as to be able to rotate separately, at least the plate cylinder 80 and the blanket cylinder 81 or the impression cylinder 82 which contact thereto are provided in each replacement unit 43, a gear 95 having a pitch diameter approximately equal to the outer diameter of the plate cylinder 80 is fixed to one end portion of the revolving shaft 94, and the plate cylinder 80 in each replacement unit 43 is positioned so as to contact to two form rollers 51 and 52 which are in the operational positions with a prescribed pressure when the replacement unit 43 has been attached to the frame 40.

12. A rotary business form printing press as set forth in claim 6 wherein a pair of disc-shaped eccentric members 110 movably fit in circular holes formed on both lateral plates 78 of the printing mechanism 2, arms for moving the eccentric members 112 fixed respectively to each eccentric member 110, a shaft 124 rotatably held by a fixed portion of the printing mechanism 2, and a converting mechanism which converts the rotation of the shaft 124 to the reciprocating linear motion and transmits it to the arms 112 are provided, and both end portions of a revolving shaft 113 of the impression cylinder 82 are held at a portion eccentric from the center of movement of the eccentric members 110.

13. A rotary business form printing press as set forth in claim 6 wherein a pair of oscillating arms 36 which respective one end portion is movably attached to a fixed portion of the sheet feed mechanism 1, a dancer roller 28 which is rotatably held between the respective oscillating end portions of these arms 36 and around which a web 14 is wound, and an air cylinder 39 provided between the oscillating arm 36 or a portion that will oscillate integrally with the oscillating arms 36 and is near to a shaft 35 of the oscillating arms 36 and said fixed portion are provided, and it is constructed that a prescribed pressure of air is supplied to the chamber in the air cylinder 39 on the side where the pressure due to the the tension of the web 14 exerts.

14. A rotary business form printing press as set forth in claim 6 wherein a receiving roller 206 for receiving the printed-and-processed web 14 and feeding it to the zigzag folding unit 211 is provided, said receiving roller 206 being of a hollow cylindrical shape and a plurality of holes 210 are formed all over the peripheral wall thereof and its inner space is connected to a vacuum device.

15. A rotary business form printing press as set forth in claim 14 wherein a slipping device 207 is provided between the receiving the roller 206 and the drive shaft 9.

* * * * *